US012359132B2

(12) United States Patent
Bobbili et al.

(10) Patent No.: US 12,359,132 B2
(45) Date of Patent: Jul. 15, 2025

(54) LIGNOCELLULOSIC BIOMASS DERIVED BIOINTERMEDIATES AND RENEWABLE FUELS

(71) Applicant: Comstock IP Holdings LLC, Milton, GA (US)

(72) Inventors: Rahul Bobbili, San Jose, CA (US); Kevin Kreisler, Miami, FL (US); Michael J. Riebel, Mankato, MN (US); Milton J Riebel, Mankato, MN (US); David Winsness, Anderson, SC (US)

(73) Assignee: Comstock IP Holdings LLC, Milton, GA (US)

( * ) Notice: Subject to any disclaimer, the term of this patent is extended or adjusted under 35 U.S.C. 154(b) by 193 days.

(21) Appl. No.: 18/348,873

(22) Filed: Jul. 7, 2023

(65) Prior Publication Data

US 2024/0191143 A1 Jun. 13, 2024

Related U.S. Application Data

(60) Provisional application No. 63/367,874, filed on Jul. 7, 2022.

(51) Int. Cl.
*C10G 3/00* (2006.01)

(52) U.S. Cl.
CPC ..... *C10G 3/50* (2013.01); *C10G 2300/1014* (2013.01); *C10G 2300/80* (2013.01)

(58) Field of Classification Search
None
See application file for complete search history.

(56) References Cited

U.S. PATENT DOCUMENTS

| | | | | |
|---|---|---|---|---|
| 5,478,366 | A | 12/1995 | Teo et al. | |
| 5,504,259 | A | 4/1996 | Diebold et al. | |
| 5,735,916 | A | 4/1998 | Lucas et al. | |
| 5,959,167 | A | 9/1999 | Shabtai et al. | |
| 9,365,525 | B2 | 6/2016 | Manesh et al. | |
| 9,382,283 | B2 | 7/2016 | Manesh et al. | |
| 2014/0100308 | A1 * | 4/2014 | Tseng | C08G 8/24 524/391 |

OTHER PUBLICATIONS

Dhyani, et al.; "A Comprehensive Review on the Pyrolysis of Lignocellulosic Biomass," Renewable Energy (2018), 129:695-716.
Lemée, et al.; "Biological Pretreatment for Production of Lignocellulosic Biofuel," Bioresource Technology (2012), 117:234-241.
Mei, et al.; "Plasma-enabled Liquefaction of Lignocellulosic Biomass: Balancing Feedstock Content for Maximum Energy Yield," Renewable Energy (2020), 157:1061-1071.

(Continued)

*Primary Examiner* — Tam M Nguyen
(74) *Attorney, Agent, or Firm* — Dunlap Codding, P.C.

(57) ABSTRACT

The present disclosure generally relates to compositions and methods of simultaneously making two unique biointermediates from a single lignocellulosic biomass feedstock, including a hydrophobic biohydrocarbon and a water insoluble hydrophilic cellulosic biopolymer for use in the production of renewable fuels, chemicals, and other carbon neutral materials commonly derived from petroleum and other fossil resources.

21 Claims, 1 Drawing Sheet

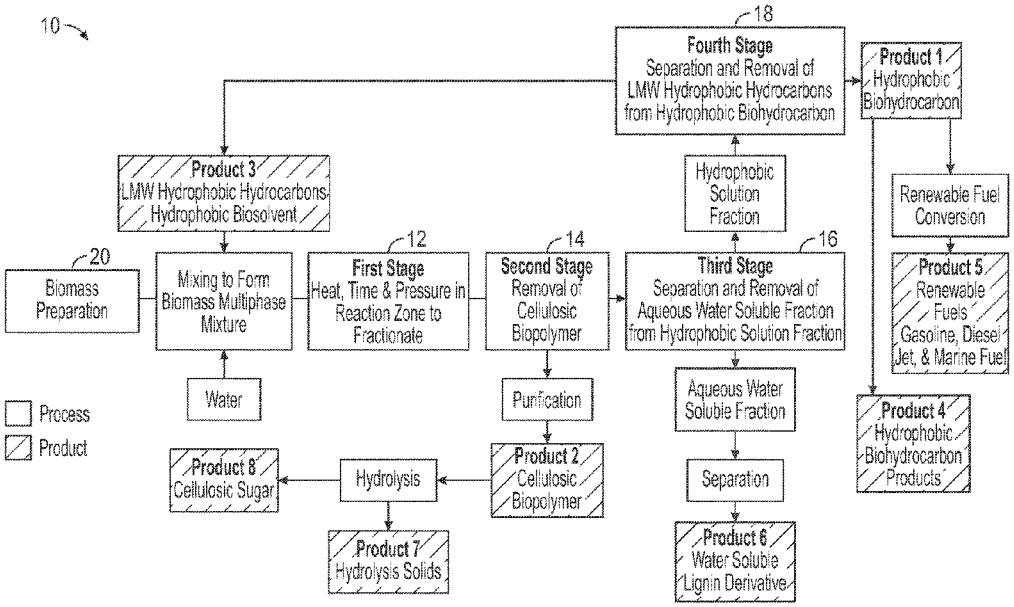

(56) References Cited

OTHER PUBLICATIONS

Okolie, et al.; "Chemistry and Specialty Industrial Applications of Lignocellulosic Biomass," Waste and Biomass Valorization, Springer (2021); printed Mar. 18, 2024.
International Search Report dated Mar. 12, 2024, in PCT/US2023/69736, filed Jul. 7, 2023.
Written Opinion of the International Searching Authority dated Mar. 12, 2024, in PCT/US2023/69736, filed Jul. 7, 2023.
Shabtai, Catalytic Functionalities of Supported Sulfides, IV C—O Hydrogenolysis.
Shabtai, J. et al., Catalytic Functionalities of Supported Sulfides, V C—N Hydrogenolysis Selectivity as a Function of Promoter Type, J. Catal. 113: 206-219 (1988)—Abstract.
U.S. Appl. No. 16/119,030 entitled Method for Separating and Recovering Lignin and Melt Flowable Biolignin Polymers, filed by David Winsness and Riebel.

* cited by examiner

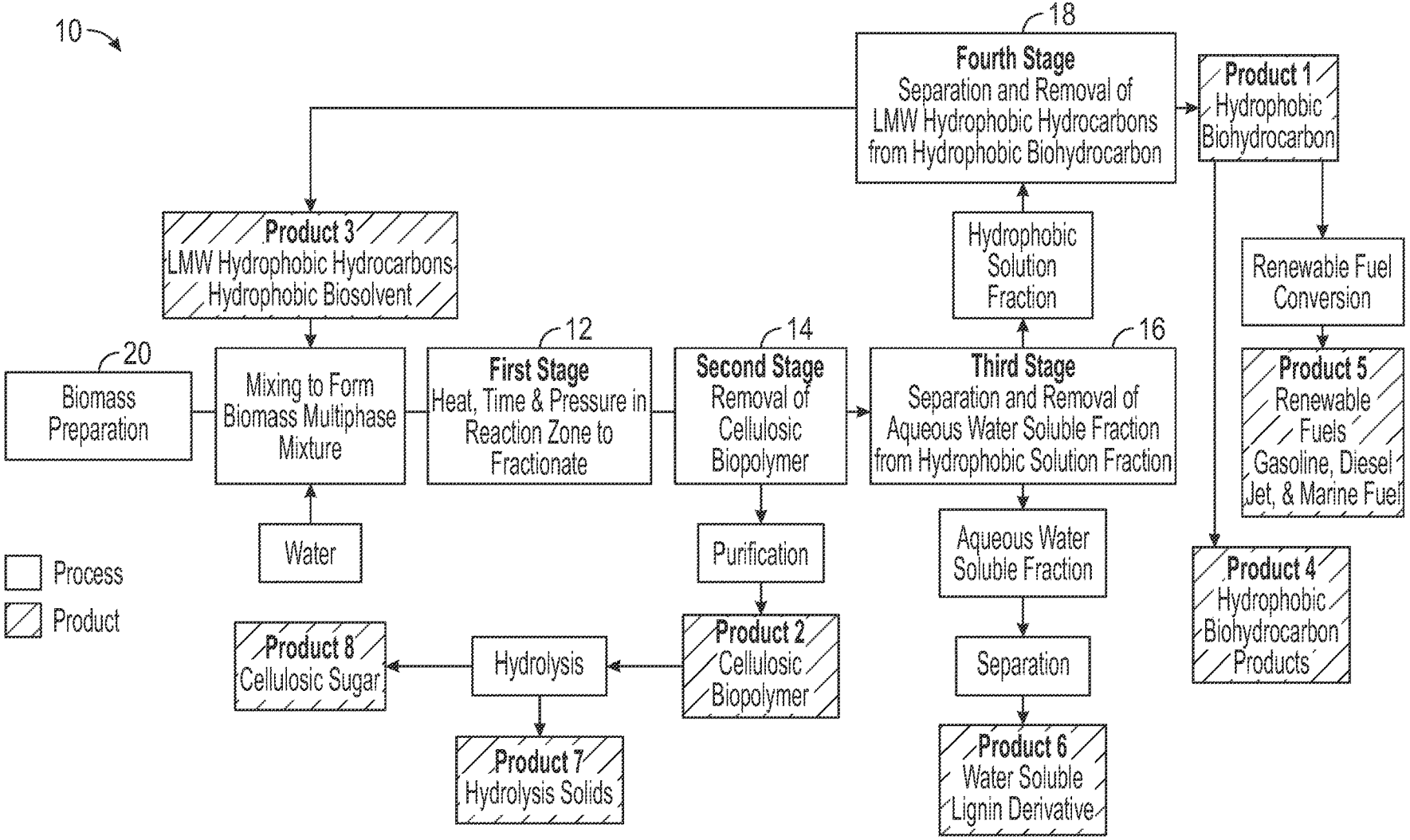
10
Biomass Preparation
20
Mixing to Form Biomass Multiphase Mixture
Water
First Stage
Heat, Time & Pressure in Reaction Zone to Fractionate
12
Second Stage
Removal of Cellulosic Biopolymer
14
Third Stage
Separation and Removal of Aqueous Water Soluble Fraction from Hydrophobic Solution Fraction
16
Fourth Stage
Separation and Removal of LMW Hydrophobic Hydrocarbons from Hydrophobic Biohydrocarbon
18
Product 3
LMW Hydrophobic Hydrocarbons
Hydrophobic Biosolvent
Product 1
Hydrophobic Biohydrocarbon
Hydrophobic Solution Fraction
Aqueous Water Soluble Fraction
Separation
Product 6
Water Soluble Lignin Derivative
Renewable Fuel Conversion
Product 5
Renewable Fuels
Gasoline, Diesel Jet, & Marine Fuel
Product 4
Hydrophobic Biohydrocarbon Products
Purification
Product 2
Cellulosic Biopolymer
Hydrolysis
Product 7
Hydrolysis Solids
Product 8
Cellulosic Sugar
Process
Product

LIGNOCELLULOSIC BIOMASS DERIVED BIOINTERMEDIATES AND RENEWABLE FUELS

INCORPORATION BY REFERENCE STATEMENT

This application claims priority to U.S. Provisional Application 63/367,874 filed Jul. 7, 2022, the entire contents of which are hereby expressly incorporated herein by reference.

BACKGROUND OF THE DISCLOSURE

The following disclosure generally relates to biomass processing and products derived thereby. More specifically, a hydrophobic biohydrocarbon derived from lignocellulosic biomass is disclosed.

An urgent need exists for carbon neutral or "net zero" products that enable decarbonization at massive scales, including in global supply chains that terminate in combustion. The present disclosure generally relates to compositions and production methods for a hydrophobic biohydrocarbon ("Hydrophobic Biohydrocarbon") alternative to fossil fuel derived petroleum crude oil for use in the production of renewable fuels, chemicals and other carbon neutral materials commonly derived from petroleum crude, in which the Hydrophobic Biohydrocarbon is derived from historically under-utilized lignocellulosic biomass and comprised, at least in part, of a mixture of mixed molecular weight hydrophobic hydrocarbons.

The presently disclosed Hydrophobic Biohydrocarbon compositions are comparable to fossil fuel derived petroleum crude oil, with high energy density and carbon content, low concentrations of oxygen, water and other impurities, and physical characteristics that are advantageous in further processing, such as by hydrodeoxygenation, hydrogenation, hydrocracking, or other similar processes, to produce "drop in" renewable fuels ("Hydrophobic Biohydrocarbon Fuels") and other products ("Hydrophobic Biohydrocarbon Products"). Compositions and production methods for Hydrophobic Biohydrocarbon Fuels and Hydrophobic Biohydrocarbon Products are additionally disclosed, including renewable diesel fuel, sustainable aviation fuel, gasoline, marine fuel, biopolymers, bioplastics, biocomposites, biochemicals, and other renewable alternatives to fossil fuel derivatives.

The presently disclosed Hydrophobic Biohydrocarbon production methods also produce a substantially Hydrophobic Biohydrocarbon free hydrophilic biopolymer co-product that is insoluble in water and comprised, at least in part, of hydrolysable anhydroglucose ("Cellulosic Biopolymer"), in which the Cellulosic Biopolymer is separated from the Hydrophobic Biohydrocarbon and made amenable for further processing, including into fermentable sugars for use in producing cellulosic ethanol and other renewable fuels ("Cellulosic Biopolymer Fuels"), as well as other products ("Cellulosic Biopolymer Products").

SUMMARY OF THE DISCLOSURE

A hydrophobic biohydrocarbon includes a mixture of substantially hydrophobic hydrocarbons derived from lignocellulosic biomass. The hydrophobic biohydrocarbon further includes hydrophobic phenols, hydrophobic organic furans, hydrophobic oleoresins, and hydrophobic esters.

In one embodiment, the hydrophobic biohydrocarbon derived from lignocellulosic biomass comprises a mixture of substantially hydrophobic hydrocarbons and further includes hydrophobic phenols, hydrophobic organic furans, hydrophobic oleoresins, and hydrophobic esters, wherein the hydrophobic biohydrocarbon has a carbon content of more than 50% by weight, an oxygen content of less than 40% by weight, a hydrogen content greater than 4%, an energy content of more than 11,000 btu per pound, a water content less than 10%, and a water soluble and hydrophilic compound content less than 10% by weight.

In one embodiment, a method of processing a lignocellulosic biomass simultaneously makes two renewable fuel feedstocks from the lignocellulosic biomass. The first is the hydrophobic biohydrocarbon comprising a mixture of substantially hydrophobic hydrocarbons further comprising hydrophobic phenols, hydrophobic organic furans, hydrophobic oleoresins, and hydrophobic esters, and the second a water insoluble hydrophilic cellulosic biopolymer that is essentially free of water-soluble lignocellulosic biomass derivatives and hydrophobic lignocellulosic biomass derivatives. Prepared lignocellulosic biomass is combined with water and at least two hydrophobic solvents to form a biomass multiphase mixture. The biomass multiphase mixture is heated and pressurized in a reaction zone for a sufficient reaction time to cause at least a portion of the biomass multiphase mixture to react and fractionate into:

1. a substantially aqueous water soluble fraction,
2. a substantially water insoluble hydrophilic cellulosic biopolymer fraction, and
3. a substantially hydrophobic solution fraction.

The water insoluble hydrophilic cellulosic biopolymer fraction that is essentially free of water soluble lignocellulosic biomass derivatives and hydrophobic lignocellulosic biomass derivatives is separated and removed. The aqueous water-soluble fraction from the hydrophobic solution fraction is separated and removed. And a low molecular weight portion of the hydrophobic solution fraction is separated and removed for recycling in producing additional biomass multiphase mixture. A remaining portion of the hydrophobic solution fraction is a hydrophobic biohydrocarbon comprising a mixture of substantially hydrophobic hydrocarbons derived from lignocellulosic biomass and further comprising hydrophobic phenols, hydrophobic organic furans, hydrophobic oleoresins, and hydrophobic esters.

In another embodiment, a water insoluble hydrophilic cellulosic biopolymer is produced that is essentially free of water soluble and hydrophobic lignocellulosic biomass derivatives and derivatives that inhibit enzymatic hydrolysis.

In yet another embodiment, a cellulosic sugar is produced by subjecting the water insoluble hydrophilic cellulosic biopolymer to enzymatic hydrolysis, acid hydrolysis, or combinations thereof.

In another embodiment, a renewable feedstock or fuel is produced by fermenting the cellulosic sugar described above to produce acetic acid, butanol, ethanol, fatty acids, lipids, triacylglycerides, or combinations thereof.

In yet another embodiment, a renewable fuel is produced by refining the ethanol produced by fermenting the cellulosic sugar, wherein the renewable fuel can include renewable gasoline, renewable diesel fuel, sustainable aviation fuel, and combinations thereof.

In another embodiment, a renewable fuel is produced by fermenting the cellulosic sugar described above and refining the fatty acids, lipids, or the triacylglycerides, or combinations thereof, wherein the renewable fuel can be renewable gasoline, biodiesel, renewable diesel fuel, sustainable aviation fuel, marine fuel, or combinations thereof.

In another embodiment, a renewable feedstock or fuel is produced by fermenting the cellulosic sugar described above to produce acetic acid, butanol, ethanol, fatty acids, lipids, triacylglycerides, or combinations thereof, and by mixing, reacting, or otherwise combining at least a portion of one or more such cellulosic sugar fermentation products with the hydrophobic biohydrocarbon to produce an integrated renewable feedstock or fuel.

In another embodiment, a renewable feedstock or fuel is produced by subjecting the cellulosic sugar described above to acid hydrolysis to produce furfural, which is then mixed, reacted, or otherwise combined with the hydrophobic biohydrocarbon to produce an integrated renewable feedstock or fuel.

In one embodiment, the hydrophobic biohydrocarbon is further processed using at least hydrodeoxygenation, hydrogenation, hydrocracking, or distillation, or combinations thereof.

In another embodiment, a liquid phase hydrophobic biohydrocarbon is produced as above and less than 80% of the low molecular weight hydrophobic hydrocarbons are removed to provide a liquid phase hydrophobic biohydrocarbon.

In yet another embodiment, a solid phase hydrophobic biohydrocarbon is produced as described above and less than 15% of the low molecular weight hydrophobic solvent remain in the hydrophobic biohydrocarbon to provide a solid phase hydrophobic biohydrocarbon.

In one embodiment, the solid phase hydrophobic biohydrocarbon has a thermoplastic melting temperature greater than 65° C. and less than 380° C.

In another embodiment, the hydrophobic biohydrocarbon comprising a mixture of substantially hydrophobic hydrocarbons derived from lignocellulosic biomass and further comprising hydrophobic phenols, hydrophobic organic furans, hydrophobic oleoresins, and hydrophobic esters, has a carbon content of 50% by weight, an oxygen content of 30% by weight, a hydrogen content of 4%, an energy content of 11,000 btu per pound, a water content of 6%, and a water soluble and hydrophilic compound content of 10% by weight.

DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings:

FIG. 1 is a flowsheet illustrating biomass processing in accordance with an embodiment of the present disclosure.

DEFINITIONS

While the following terms are believed to be well understood by one of ordinary skill in the art, the following definitions are set forth to facilitate explanation of the presently disclosed subject matter.

Following long-standing patent law convention, the terms "a", "an", and "the" refer to "one or more" when used in this application, including the claims. Thus, for example, reference to "a hydrophobic biohydrocarbon" includes a plurality or mixture of hydrophobic hydrocarbons produced, at least in part, upon depolymerization or other reaction of the hemicellulose, lignin, or extractives fractions of lignocellulosic biomass.

Unless otherwise indicated, all numbers expressing quantities of size, such as length, width, diameter, thickness, volume, mass, force, strain, stress, time, temperature, or other conditions, and so forth that are used in the specification and claims are to be understood as being modified in all instances by the term "about". Accordingly, unless indicated to the contrary, the numerical parameters set forth in this specification and attached claims are approximations that can vary depending upon the desired properties sought to be obtained by the presently disclosed subject matter.

The use of the term "or" in the claims is used to mean "and/or" unless explicitly indicated to refer to alternatives only or the alternatives are mutually exclusive, although the disclosure supports a definition that refers to only alternatives and "and/or." As used herein "another" can mean at least a second or more.

As used herein, the term "and/or" when used in the context of a listing of entities, refers to the entities being present singly or in combination. Thus, for example, the phrase "A, B, C, and/or D" includes A, B, C, and D individually, but also includes any and all combinations and sub-combinations of A, B, C, and D.

The term "comprising", which is synonymous with "including," "containing," or "characterized by" is inclusive or open-ended and does not exclude additional, unrecited elements or method steps. "Comprising" is a term of art used in claim language that means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter.

With respect to the terms "comprising", "consisting of", and "consisting essentially of", where one of these three terms is used herein, the presently disclosed and claimed subject matter can include the use of either of the other two terms.

"Anhydroglucose" means one or more anhydroglucose units comprised of single sugar molecules in a polymer.

"Biohydrocarbon" means a material comprising carbon and hydrogen derived from a biological feedstock, such as lignocellulosic biomass.

"Biopolymer" is a natural polymer from a biological feedstock consisting, at least in part, of monomeric units that are covalently bonded to form larger molecules.

"Cellulose" is a component of lignocellulosic biomass that is substantially comprised of hydrophilic, water insoluble, hydrolysable linear anhydroglucose polymers.

"Depolymerization" means a process of converting a polymer into a mixture of monomers, oligomers, and/or other polymers.

"Enzymatic Hydrolysis" means enzymatic catalytic decomposition of hydrolysable substances by reaction with water.

"Extractives" means non-structural solvent extractable components of lignocellulosic biomass, such saps and resins that are typically highly hydrophobic and comprised of a complex mixture of tannins, terpenes, rosins, resins, polyphenols, lipids, waxes, esters, wax esters, oils, and various organic acids, in which various percentages are dependent on species and other factors.

"Hemicellulose" is a component of lignocellulosic biomass that is substantially comprised of polysaccharidic polymers with branching chains that use covalent bonding to cross-link non-cellulosic and cellulosic polymers, and that forms water soluble, water insoluble hydrophilic, and hydrophobic derivatives.

"Hydrophilic" means tending to mix with, dissolve in, be wetted by, or are attracted to water.

"Hydrophobic" means tending to repel or fail to mix with water.

"Lignin" is a component of lignocellulosic biomass that is substantially comprised of naturally occurring three dimensional polymeric "structural resin" that binds cellulose, hemicellulose, and other components of lignocellulosic biomass together, and that forms water soluble, water insoluble hydrophilic, or hydrophobic derivatives.

"Lignocellulosic Biomass" (or "biomass" or "woody biomass") refers to biological matter comprised of four primary material groups: cellulose, hemicellulose, lignin, and extractives.

"Pyrolysis Oil" (or "bio-oil") is a liquid produced upon thermal or chemical decomposition of lignocellulosic biomass without prior fractionation, resulting in an amalgamated mixture of water soluble, water insoluble hydrophilic, and hydrophobic lignocellulosic biomass derivatives, amongst other components. "Pyrolytic Sugar" means thermally decomposed sugar.

"Reactive Phase Separation" refers, as used herein, to the separation of two liquids at an extent, rate, or manner in which one or more components within one liquid are inhibited from reacting by one or more components of the other liquid, such that the one or more components of the first liquid react upon separation of the second liquid from the first liquid.

"Carbon Content" is as tested, for example, by ASTM D5375 methods in weight percent.

"Energy Content" is as tested, for example, by ASTM E711 methods in British thermal units (Btu) per pound.

"Hydrogen Content" is as tested, for example, by ASTM D5373 methods in weight percent.

"Melting Point" is as tested, for example, by DSC-ASTM D3418 in degrees Celsius.

"Moisture Content" is as tested, for example, by ASTM E871 methods in weight percent.

"Oxygen Content" is as tested, for example, by ASTM D3176 methods in weight percent.

DETAILED DESCRIPTION OF EXEMPLARY EMBODIMENTS

Electrification and continued advancements in energy storage are vitally necessary to reduce reliance on fossil fuels. However, most of the electricity needed to power that infrastructure is currently generated by the combustion of fossil fuels, notwithstanding the impact of increased global urgency, continued innovation, and the accelerating growth of renewable energy. Simultaneously, about 9% of the estimated 70 million new vehicles sold worldwide in 2021 were electric. While electric vehicle ("EV") sales are anticipated to account for 30% to 50% of new vehicle sales by 2030, there will only be about 145 million EVs on the road in 2030 under aggressive growth scenarios. In contrast, there were more than 1.45 billion passenger cars and commercial vehicles in use worldwide at the end of 2020, and more than 98% of them were powered by gasoline or diesel fuel. Those vehicles accounted for 63% of the 7.3 billion metric tons of carbon dioxide emitted by the transportation sector in 2020, and that amount is expected to increase by more than 50% as the combustion fleet continues to grow beyond 2030. Similar increases are expected for other forms of mobility. Combustion is consequently expected to continue to be a dominant source of power for decades to come, if for no other reason than the fact that combustion infrastructure is already deployed on a planetary scale. Thus, there is an extraordinary and increasing global demand for renewable fuels as humanity amplifies efforts to decarbonize and reduce the effects of global climate change.

Most current forms of renewable fuel draw from the same pool of conventional feedstocks, including corn and various vegetable oils in the U.S., and the entire universe of those feedstocks only represents a tiny fraction of global fuel consumption for mobility and energy. Further, the lifecycle carbon benefits of growing, harvesting, and using conventional renewable fuel feedstocks are limited in comparison to fossil fuels. Therefore, any plan to accelerate global decarbonization using renewable fuels must involve abundant feedstocks that are not used today.

Lignocellulosic biomass has vast untapped potential to meet that need with lifecycle carbon benefits that are dramatically superior to conventional feedstocks. Indeed, fossil hydrocarbons form when, in pertinent part, photosynthetic organisms convert energy from the sun, water, and carbon dioxide ("$CO_2$") into stored chemical energy comprising lignocellulosic and other forms of biomass that are buried and sequestered in the Earth's crust and mantle, where they are converted with heat, pressure, and time into fossil hydrocarbons, including petroleum, natural gas, and coal. Historical attempts to bypass sequestration and accelerate that process by directly converting lignocellulosic biomass into fuel have failed to produce a sufficiently profitable or commercially viable process to incentivize broad market adoption, primarily due to the evolved natural recalcitrance of lignocellulosic biomass. As a result, only small quantities of lignocellulosic biomass are used for renewable fuel feedstock today.

Lignocellulosic biomass is comprised of cellulose, hemicellulose, and lignin, amongst other components. Cellulose is further comprised of linear anhydroglucose polymers that form the structure of cell walls. Hemicellulose is characterized by polysaccharidic polymers with branching chains that use covalent bonding to cross-link non-cellulosic and cellulosic polymers. Lignin is a naturally occurring three dimensional polymeric "structural resin" that binds the cellulose, hemicellulose, and other components together, while imparting the strength, protection, and other attributes necessary for the host organism to survive, grow and compete in its resident ecosystem. These attributes include hydrophobicity, hydrophilicity, and other natural properties that facilitate intracellular transport and resistance to hydrolytic, oxidative, and other forms of degradation. Collectively, those properties converge to provide lignocellulosic biomass with natural recalcitrance to the physiochemical conditions required for conversion into renewable fuels and other fossil fuel offsets.

Known attempts to produce renewable fuels from lignocellulosic biomass that focus on "overcoming" recalcitrance typically suffer from various failings, such as extensive use of corrosive chemicals, high energy consumption, feedstock intolerance, intermediate and final product contamination, impractical renewable fuel conversion yield, and high carbon intensity. In contrast, the presently disclosed methods exploit natural attributes giving rise to recalcitrance, including, in some embodiments, hydrophobic, hydrophilic, and other fractional constituent properties, and improve upon natural petroleum hydrocarbon production processes by directly converting lignocellulosic biomass into the presently disclosed Hydrophobic Biohydrocarbon and Cellulosic Biopolymer compositions. The resulting Hydrophobic Biohydrocarbon and Cellulosic Biopolymer compositions are in turn amenable for further processing into Hydrophobic Biohydrocarbon Fuels and Cellulosic Biopolymer Fuels, respectively, at sufficient yields and throughput to incentivize broad market adoption, including renewable diesel fuel, sustainable aviation fuel, gasoline, marine fuel, cellulosic ethanol, and cellulosic oil.

Lignocellulosic biomass feedstock (which is also alternatively referred to herein as "woody biomass" or "biomass") includes any cellulose-containing material, including, but not limited to, wood chips, sawdust and other sawmill residuals, slash and other forestry residuals, tree trimmings from forest fire control practices, agricultural and other wood wastes, as well as short rotation trees, energy crops, and other virgin resources, such as poplar, pine, willow, grasses, hemp, and bamboo.

Various attempts to convert biomass into renewable fuels, chemicals, or other materials have been disclosed. For example, a series of treatments of plant biomass resulting in the production of ethanol, lignin, and other products is disclosed in U.S. Pat. No. 5,735,916, which teaches a process in which sugars are produced and fermented to ethanol using a closed-loop fermentation system that employs thermophilic bacterium. The resulting ethanol is then mixed with unconverted lignin from the input biomass to produce a high energy fuel. Such approaches are highly problematic because lignin and other hydrophobic derivatives of the source biomass, such as furfural, wood extracts, oleoresins, monomeric phenols, and other substances inhibit hydrolysis of cellulose into fermentable sugars. Such components are known to bind to and disable enzymes used to hydrolyze cellulose into fermentable sugars. The inability to separate and remove hydrophobic derivatives has therefore greatly limited commercialization of biological processes involving conversion of cellulose into ethanol.

U.S. Pat. No. 5,478,366 discloses preparation of a pumpable slurry for recovering fuel value from lignin by mixing lignin with water, fuel oil and a dispersing agent, the slurry being defined as a pourable, thixotropic or near Newtonian slurry containing 35% to 60% (by weight) of lignin. Similar efforts propose conversion of biomass and refuse derived fuel ("RDF") into synthesis gas ("syngas") prior to conversion into a liquid fuel by means of gas to liquid refining ("GTL"). U.S. Pat. No. 5,504,259 discloses a high temperature (450° C. to 550° C.) process for conversion of biomass and RDF into ethers, alcohols, or a mixture thereof, comprising pyrolysis of dried feed in a vortex reactor, catalytic cracking of the resulting pyrolysis vapors, condensation of aromatic byproducts, alkylation of benzene, catalytic oligomerization of ethylene and propylene into higher olefins, isomerization of olefins to branched olefins, and catalysis of branched olefins with alcohol to form an alkyl t-alkyl ether suitable for use as a blending component in reformulated gasoline. Other attempts to produce pyrolysis oil from biomass or lignin subject a portion of the feedstock to high heat in a reduced oxygen environment to create a syngas that is condensed into a residual oil product, while the balance of the feedstock results in a "biochar" or ash waste or co-product. Syngas from biomass has also been used wherein the biomass is heated to high heat under a low or no oxygen environment to create a vapor syngas, which is then converted into liquid fuel by means of a catalyst in a typical Fischer Tropsch GTL process. Such approaches require extensive processing equipment to convert solid phase lignocellulosic biomass feedstocks into gaseous phase intermediates and liquid phase final products at the expense of efficiency, yield, and prohibitive capital and operating costs, thereby limiting commercial adoption.

Hydrothermal liquefaction ("HTL") has also been used to create "bio-oil" from various lignocellulosic biomass and other carbonaceous feedstocks. In such processes, water is mixed with feedstock and subjected to a form of pyrolysis at high pressures and temperatures (typically 350° C. to more than 400° C.), at the expense of significant energy inputs. The viability of such processes is limited because such processes skip fractionation to fully depolymerize cellulose, hemicellulose, lignin, and other woody biomass feedstock components together, contributing to contamination and yield loss. For example, cellulosic and hemicellulosic components convert to sugars and other derivatives which undergo pyrolytic conversion into humin or char materials that contaminate downstream fuel production and are costly to remove. Pyrolytic residuals are also generally hydrophilic with a natural affinity to water, and thus typically contribute to prohibitive water contamination in HTL bio-oil products. In addition, many HTL processes are conducted in an alkaline environment by introducing various hydroxides, however, hydroxide addition limits the production of value-added intermediates, such as furfural and organic furans, and results in various salts and other impurities in the resulting bio-oil product. Such factors have limited the commercialization of HTL processes and the market adoption of bio-oil from biomass.

In contrast, the presently disclosed Hydrophobic Biohydrocarbon production methods fractionate hydrophobic and hydrophilic components from the source biomass, and therefore result in Hydrophobic Biohydrocarbon compositions that are substantially hydrophobic and substantially free of hydrophilic components, with negligible sugar, water, and other impurities that may create problems in downstream fuel refining and other processes. In addition, by fractionating hydrophobic and hydrophilic components from the source biomass, the disclosed Hydrophobic Biohydrocarbon production method also produces Cellulosic Biopolymer compositions that are substantially hydrophilic and substantially free of hydrophobic components and other impurities known to contaminate downstream biological and other renewable fuel production processes. For example, the Cellulosic Biopolymer contains water soluble and hydrophilic compounds at a concentration of less than 10% by weight, more preferably less than 5% by weight, and more preferably less than 2% by weight. Thus, in contrast to known methods to convert biomass that only produce one primary product and byproducts with negligible value or that create disposal issues at increased cost, the presently disclosed and claimed methods produce two primary products: (1) Hydrophobic Biohydrocarbon, an alternative to fossil fuel derived petroleum crude oil, for use in producing Hydrophobic Biohydrocarbon Fuels or Hydrophobic Biohydrocarbon Products; and (2), a substantially Hydrophobic Biohydrocarbon free Cellulosic Biopolymer, a hydrophilic biopolymer for use in producing Cellulosic Biopolymer Fuels or Cellulosic Biopolymer Products.

Various other prior art attempts to use woody biomass in similar applications start with fractionated natural lignin, or a conventional byproduct from fractionated lignin, such as kraft lignin, lignosulfonate, or so-called "organosolv" lignin, all of which are characterized by high concentrations of various impurities and problematic chemical components that limit their amenability for conversion into offsets for petroleum derivatives. Further, natural lignin, kraft lignin, lignosulfonate, and organosolv lignin are not completely hydrophobic or substantially free of hydrophilic components and are therefore known to problematically absorb water at concentrations exceeding 30% by weight.

For example, kraft pulping to produce paper from biomass is a well-known and common practice, in which lignin residuals ("kraft lignin") and other byproducts are produced and typically burned for little to no value. In addition, kraft lignin, lignosulfonate, and other byproducts of such processes, along with residual salts, create further limitations for downstream processing, such as in the case of U.S. Pat. No. 5,959,167, which teaches conversion of kraft lignin into gasoline by reaction with an alcohol and various hydroxides under supercritical conditions. Within that art, the lignin is unmodified and contaminated by hydroxides and other impurities that complicate downstream processing. The resulting lignin with impurities also has a very wide range of molecular weights and complex chemistry that further decreases yield and creates undesired byproducts in subsequent processing. Such approaches consequently require costly additional process steps and high energy inputs that frustrate commercialization. Further, while methods exist to pretreat, beneficiate, and use conventional lignin sources, such methods are ultimately constrained by the availability of conventional feedstocks, and their maximum yield is limited to the extent that strategies for conversion of cellulose, hemicellulose, and extractives are not incorporated.

The presently disclosed Hydrophobic Biohydrocarbon compositions are not lignin. Rather, the presently disclosed Hydrophobic Biohydrocarbon compositions are derived from lignin, and the presently disclosed Hydrophobic Biohydrocarbon compositions are distinguishable from known lignin byproduct variations, such as kraft lignin, lignosulfonate, and organosolv lignin. The lignin fraction of the input biomass is further comprised of water soluble, water insoluble hydrophilic, and hydrophobic components, in which the water soluble and water insoluble hydrophilic components impede conversion of the hydrophobic components into value-added products, such as the presently disclosed Hydrophobic Biohydrocarbon compositions and derivatives thereof. Accordingly, the lignin fraction of the input biomass undergoes depolymerization, separation, and other reactions during the presently disclosed Hydrophobic Biohydrocarbon production methods, including, in some embodiments, co-processing with one or more hydrophobic biosolvents ("HBS"), such as butyl acetate, butyl ester, oleoresins, organic furans, fatty acids, rosins, terpenes, wood extracts, hemicellulose derivatives, such as furfural and 5-hydroxymethylfurfural ("HMF"), and one or more derivatives of one or more of the foregoing, to create the mixture of mixed molecular weight hydrophobic biopolymers comprising the presently disclosed Hydrophobic Biohydrocarbon compositions, amongst other derivatives. Advantageously, and in further contrast to known processes, while one or more HBS components can be sourced from virgin raw materials, one or more HBS components can be co-produced in situ during Hydrophobic Biohydrocarbon production from fractions of the input biomass that do not convert to Hydrophobic Biohydrocarbon, and then separated from Hydrophobic Biohydrocarbon and reserved for reintroduction and use in subsequent Hydrophobic Biohydrocarbon production.

A form of catalysis is required to produce diesel, gasoline, and other fuels from carbonaceous feedstocks, such as fluid catalytic cracking or hydrocracking, and such processes require liquid phase feedstocks. The presently disclosed Hydrophobic Biohydrocarbon compositions can be produced as solid or liquid phase products depending on the level of HBS separation from the Hydrophobic Biohydrocarbon, as may be warranted by product specification, prevailing market, and other considerations. However, substantially HBS free solid phase Hydrophobic Biohydrocarbon compositions transition to liquid phase at elevated temperatures, with highly favorable handling and downstream processing implications in renewable fuel applications, as well as novel melt-flowable thermoplastic characteristics in bioplastic and other biopolymer applications. Known biological, GTL, HTL and other biomass conversion processes produce liquid phase products, however, such products suffer from the inherent failings described above and the resulting products contain significant impurities. Likewise, conventional lignin and other biomass sources typically degrade at elevated temperatures, long before reaching any melting point or glass transition point, and therefore do not convert into a liquid phase for conversion into drop-in renewable fuels unless the conventional lignin and other biomass sources are dissolved with an alcohol or other solvent, and, even then, many components are not fully soluble.

Lignocellulosic biomass is ubiquitous and rapidly-replenishable, and yet lignocellulosic biomass is not conventionally used as a renewable fuel feedstock, in large part because of the foregoing considerations. However, the lifecycle carbon benefits of growing, harvesting, and using conventional renewable fuel feedstocks are limited in comparison to fossil fuels, and the decarbonization benefits of using renewable fuel derived from lignocellulosic biomass have far greater potential. Terrestrial lignocellulosic biomass is naturally replenished from carbon extracted from the Earth's atmosphere, and a portion of that carbon is sequestered in the soil with root systems that are not removed at harvest. In a simple example of the associated impact, sustainably harvesting about 3.4 billion metric tons per year of lignocellulosic biomass would be enough to absorb 4.0 billion metric tons of $CO_2$ per year and produce more than 1.5 billion metric tons per year of renewable fuels with the inventive compositions and methods. That fuel would in turn shift 10% of the global fuel burn to "short cycle" sources (which contain carbon that was recently photosynthesized into biomass with a net zero impact on the flux of carbon above the Earth's surface), and thereby reduce the net addition of previously sequestered "long cycle" fossil $CO_2$ into the Earth's atmosphere and oceans by about 4.0 billion metric tons, reducing worldwide carbon emissions from 40 billion to 36 billion metric tons per year. Total fuel consumption worldwide would remain at about 15 billion metric tons per year, and total $CO_2$ equivalent emissions would remain at about 40 billion metric tons per year, but 10% of the global burn would be circular with a net zero or net negative impact on atmospheric $CO_2$ concentrations. Such benefits would be further improved by efficiently utilizing waste and other under-utilized forestry, agricultural, and conventional lignocellulosic biomass processing residuals.

There would be no need to extract and use fossil carbon sources for the corresponding portion of the global fuel consumption with sustainable forestry, land use, and waste management practices that produce, harvest, utilize, and replenish the biomass needed to fill the demand.

In that fashion, the presently disclosed compositions and methods enable massive volumes of historically untapped, widely available, geographically distributed, and rapidly-replenishable lignocellulosic biomass supplies to become a commercially viable new feedstock to produce dramatically increased volumes of renewable fuels and other low carbon alternatives for fossil fuel derivatives, and thereby provide a timely and important means of enabling systemic decarbonization and contributing to a net zero carbon world by leveraging the Earth's natural carbon cycle and pre-existing planetary-scale combustion infrastructure.

The present disclosure generally relates to compositions and production methods for a Hydrophobic Biohydrocarbon alternative to fossil fuel derived petroleum crude oil for use in the production of renewable fuels, chemicals and other materials commonly derived from petroleum crude, in which the Hydrophobic Biohydrocarbon is derived from historically under-utilized lignocellulosic biomass and comprised, at least in part, of a mixture of mixed molecular weight hydrophobic hydrocarbons.

The presently disclosed Hydrophobic Biohydrocarbon compositions are comparable to fossil fuel derived petroleum crude oil, with high energy density and carbon content, low concentrations of oxygen, water and other impurities, and physical characteristics that are advantageous in further processing, such as by hydrodeoxygenation, hydrogenation, hydrocracking, or other similar processes, to produce "drop in" renewable fuels ("Hydrophobic Biohydrocarbon Fuels") and other products ("Hydrophobic Biohydrocarbon Products"). Compositions and production methods for Hydrophobic Biohydrocarbon Fuels and Hydrophobic Biohydrocarbon Products are additionally disclosed, including renewable diesel fuel, sustainable aviation fuel, gasoline, marine fuel, biopolymers, bioplastics, biocomposites, biochemicals, and other renewable alternatives to fossil fuel derivatives.

The produce a substantially Hydrophobic Biohydrocarbon free hydrophilic biopolymer co-product that is insoluble in water and comprised, at least in part, of hydrolysable anhydroglucose ("Cellulosic Biopolymer"), in which the Cellulosic Biopolymer is separated from the Hydrophobic Biohydrocarbon and made amenable for further processing, including into fermentable sugars for use in producing cellulosic ethanol and other renewable fuels ("Cellulosic Biopolymer Fuels"), as well as other products ("Cellulosic Biopolymer Products").

The presently disclosed Hydrophobic Biohydrocarbon compositions are not lignin. Rather, the Hydrophobic Biohydrocarbon compositions are derived from lignin, and are distinguishable from known lignin byproduct variations, such as kraft lignin, lignosulfonate, and organosolv lignin. The lignin fraction of the input biomass undergoes depolymerization and other reactions during the presently disclosed Hydrophobic Biohydrocarbon production methods, including, in some embodiments, co-processing with one or more hydrophobic biosolvents ("HBS"), such as butyl acetate, butyl ester, oleoresins, organic furans, fatty acids, rosins, terpenes, wood extracts, hemicellulose derivatives, and one or more derivatives of one or more of the foregoing, to create the mixture of lignin-derived mixed molecular weight hydrophobic biopolymers comprising the presently disclosed Hydrophobic Biohydrocarbon compositions, amongst other derivatives. Advantageously, and in further contrast to known processes, while one or more HBS components can be sourced from virgin raw materials, one or more HBS components can be co-produced in situ during Hydrophobic Biohydrocarbon production from fractions of the input biomass that do not convert to Hydrophobic Biohydrocarbon, and then separated from Hydrophobic Biohydrocarbon and reserved for reintroduction and use in subsequent Hydrophobic Biohydrocarbon production.

The presently disclosed and claimed methods fractionate and produce multiple products from a single lignocellulosic biomass including, but not limited to, the Hydrophobic Biohydrocarbon, HBS, and Cellulosic Biopolymer compositions disclosed herein. In various embodiments, Hydrophobic Biohydrocarbon may remain in a liquid phase if sufficient concentrations of hydrophobic solvents are present, including but not limited to, HBS. Although Hydrophobic Biohydrocarbon may be solid at room temperature in other embodiments, it can also be in a thermoplastic melt flowable or liquid flowable form at elevated temperatures without HBS or other solvents, providing for further processing into various fuels or polymeric materials analogous to petroleum crude applications.

Biomass Composition Overview

A wide range of biomass inputs can be used including, but not limited to, trees, sawdust, wood chips, wood flour, wood residue, tree bark, willow stems, grasses, seed hulls, soybean hulls, nut hulls, agricultural fibers, corn stover, wood, distillers dried grains, distillers solubles, soybean oil processing sludge, lignin, kraft lignin, grasses, hemp fiber, bamboo, and other biomass or biobased material sources. Some embodiments use wood residues or waste from various wood or lumber mills, tree trimming scraps or rapidly grown woody biomass crops such as shrub willow or hybrid popular trees.

Biomass is comprised of four primary material groups: cellulose, hemicellulose, lignin, and extractives. Cellulose is further comprised of linear anhydroglucose polymers that form the structure of cell walls. Hemicellulose is characterized by polysaccharidic polymers with branching chains that use covalent bonding to cross-link non-cellulosic and cellulosic polymers. Lignin is a naturally occurring three dimensional polymeric "structural resin" that binds the cellulose, hemicellulose, and other components together, while imparting the strength, protection, and other attributes necessary for the host organism to survive, grow and compete in its resident ecosystem. These attributes include hydrophobicity, hydrophilicity, and other natural properties that facilitate intracellular transport and resistance to hydrolytic, oxidative, and other forms of degradation. Extractives, such as waxes, suberin, cutin, glycosides, and alkaloids, also protect plants against unfavorable biotic and abiotic influences. Collectively, those properties converge to provide lignocellulosic biomass with natural recalcitrance to the physiochemical conditions required for conversion into renewable fuels and other fossil fuel offsets.

Cellulose is comprised of linear anhydroglucose polymers that, upon separation from hemicellulose, lignin, and extractives, contribute to formation of inventive Cellulosic Biopolymer compositions that are insoluble in water and hydrolysable into fermentable sugars, such as glucose.

Hemicellulose is hydrolysable into hexose (mannose, glucose, and galactose) and pentose (arabinose and xylose), and can be transformed into value-added chemicals, such as ethanol, xylitol, levulinic acid, and, in some embodiments involving HBS formation from hemicellulose derivatives, furfural and 5-hydroxymethylfurfural ("HMF").

Lignin is comprised, in pertinent part, of three major monolignols, p-coumaryl alcohol (H), coniferyl alcohol (G), and sinapyl alcohol (S), including at ratios that vary according to plant source. Softwoods are generally rich in coniferyl units. Hardwoods and grasses are typically rich in coniferyl and sinapyl units. On a mass flow basis, lignin primarily contributes to the inventive Hydrophobic Biohydrocarbon compositions disclosed herein, however, extractives also make an important contribution.

Extractives include saps and resins that are typically highly hydrophobic and comprised of a complex mixture of tannins, terpenes, rosins, resins, polyphenols, lipids, waxes, esters, wax esters, oils, and various organic acids, in which various percentages are dependent on the tree species and location in the tree. For example, in the case of softwood pine species, extractives can range from 5% in stem wood to 16% in branches, 25% in bark, and 40% in needles. Resins (which are also alternatively referred to herein as "tree resins" or "oleoresins") are a mixture of various substances, of which resin acids, terpene-type hydrocarbons, terpenoid alcohols, and waxes predominate. Terpenes are largely monoterpenes that generally comprise about 25% of the total weight of resin. The remainder of the liquid fraction is chiefly sesquiterpenes (up to 20%). Thus, the aggregate of all terpenes in resin is in the range 25% to 45% by weight. It is generally agreed that terpenes are formed by polymerization of isoprene (C5H8) from hemiterpenes through monoterpenes up to polyterpenes (including rubber and gutta). Monoterpenes (C10H16) and sesquiterpenes (C15H24), such as turpentine and farnesyl diphosphate ("FPP"), are generally volatile, giving fluidity and characteristic odor to resin. Turpentine constitutes the largest group of secondary products and derives from isopentenyl pyrophosphate ("IPP"). Non-volatile diterpenic acids (C20H32) are particularly important in resin, and are the most frequent and abundant diterpenoid resin compounds occurring in rosin, deriving from abietane, pimarane, and isopimarane. Doubling (dimerization) of FPP (C15H24) leads to triterpene compounds (C30H52), including a wide variety of structurally diverse substances. These terpene fractions make up a valuable natural source of materials for chemical industries in myriad applications. The foregoing are examples of various extractive derivatives that contribute to Hydrophobic Biohydrocarbon compositions.

Production Process Overview

Referring now to FIG. 1, in some embodiments, the disclosed production process 10 provides for a first stage that converts at least a portion of the hemicellulose fraction into various biochemicals, such as organic furans, and depolymerizes at least a portion of the lignin fraction into various hydrophobic biopolymers, such as phenolic monomers and oligomers. In doing so, the first stage 12 of the disclosed process 10 can sever at least a portion (and in some embodiments substantially all) of the linkages between cellulose, hemicellulose, and lignin, thereby forming a mixture of substantially hydrophobic and substantially hydrophilic fractions. Significantly, the foregoing severance aspect of the disclosed process has the effect of "disinhibiting" or conditioning and fractionating the cellulose, hemicellulose, and lignin fractions for subsequent separation, removal, and conversion into their respective Hydrophobic Biohydrocarbon, HBS, and Cellulosic Biopolymer derivatives.

A second stage 14 of the disclosed process 10 involves the efficient separation and removal of water insoluble hydrophilic components from water-soluble hydrophilic components and various Hydrophobic Biohydrocarbon and HBS precursors, wherein the removed water insoluble hydrophilic components are substantially comprised of hydrolysable anhydroglucose and are substantially free of inhibitory hydrophobic components and other impurities known to contaminate downstream biological and other renewable fuel production processes, thereby forming the inventive Cellulosic Biopolymer compositions for use in subsequent processing into Cellulosic Biopolymer Fuels or Cellulosic Biopolymer Products.

A third stage 16 of the disclosed process 10 reacts derivatives of hemicellulose (such as organic furans), lignin (such as phenolic monomers and oligomers), and extractives (such as various acids and oleoresins) in a multiphase liquid comprising water and a mixture of hydrophobic solvents, including, but not limited to, HBS. The resulting interactions culminate in two liquid streams that are then separated corresponding to each phase: (1) an aqueous phase with water soluble and substantially hydrophilic components (such as organic furans, residual sugars, acetic acid, formic acid, residual salts and other substances that would otherwise contaminate the inventive Hydrophobic Biohydrocarbon compositions), and (2) a liquid organic phase with substantially hydrophobic components (i.e., substantially hydrophobic solution fraction). The foregoing aqueous phase with water soluble and substantially hydrophilic components may be conducted for treatment to produce a substantially impurity free working solution, which may be routed back to the head of the disclosed production process for reuse, with the remaining portion conducted for industrial discharge or other application.

A fourth stage 18 of the disclosed process 20 conducts the substantially hydrophobic solution fraction from the foregoing third stage for removal (such as by evaporation) of at least a portion of the hydrophobic solvents, including, but not limited to, HBS, in which the rate and extent of solvent removal can be established to contribute to and complete formation of specific liquid or solid phase Hydrophobic Biohydrocarbon compositions for use in subsequent processing into desired Hydrophobic Biohydrocarbon Fuels or Hydrophobic Biohydrocarbon Products.

In various embodiments the disclosed Hydrophobic Biohydrocarbon compositions are modified to optimize compositions for one or more specific applications by one or more of the following additional methods: (1) introducing one or more additives during one or more of the first, third, or fourth stages of the inventive production process; (2) changing physiochemical process conditions during one or more of the first, third, or fourth stages of the inventive production process; or (3), introducing additional processing steps before, during, or after one or more of the first, third, or fourth stages of the inventive production process.

For example, the disclosed Hydrophobic Biohydrocarbon compositions readily react (during or after the one or more of the first, third, and fourth stages of the inventive production process), with various resource donors, such as organic acids, oils, lipids, free fatty acids, triacylglycerides, hydrocarbons, biomass, carbon black, biochar, various esters, various acetates, or other sources of carbon or hydrogen, to provide enriched mixtures for conversion. The disclosed production process also facilitates favorable in situ reactions, such as depolymerization, esterification, or acetylation, to produce Hydrophobic Biohydrocarbon mixtures with reduced organic oxygen, increased hydrogen or energy content, or increased carbon-carbon coupling or molecular weights.

Conversion Process Overview

The Hydrophobic Biohydrocarbon product produced in the fourth stage of the foregoing disclosed production processes is conducted in various embodiments for fluid cracking, hydrocracking, or other processes to create reduced carbon, carbon neutral, and carbon negative renewable fuels and other alternatives to fossil fuel derivatives, such as renewable diesel fuel, sustainable aviation fuel, gasoline, marine fuel, biopolymers, bioplastics, biocomposites, and biochemicals.

The "disinhibited" and substantially impurity free Cellulosic Biopolymer produced in the second stage of the foregoing disclosed production processes is conducted in various embodiments for enzymatic or other hydrolysis into fermentable sugars, such as glucose, and a solid phase co-product ("hydrolysis solids"). In various embodiments, the hydrolysis solids can be sold for use by third parties, directly used as a feedstock for heat and power production or routed back to the head of the inventive production process for conversion into various biochemicals, hydrophilic biopolymers, or hydrophobic biopolymers. Likewise, the fermentable sugars can be sold for fermentation or other uses by third parties, or directly conducted to fermentation immediately upon production, to further produce reduced carbon, carbon neutral, and carbon negative renewable fuels and other products, such as acetic acid, butanol, ethanol, fatty acids, lipids, triacylglycerides, or other fermentation derivatives. In embodiments involving the resulting lignocellulosic biomass derived ethanol ("cellulosic ethanol"), one or more additional catalytic or other steps can be applied to convert the cellulosic ethanol into sustainable aviation fuel. Likewise, in embodiments involving the resulting lignocellulosic biomass derived fatty acids, lipids, or triacylglycerides ("cellulosic oil"), one or more additional catalytic or other steps can be applied to convert the cellulosic oil into biodiesel or renewable diesel.

Detailed Description of Production Process

Biomass Preparation 20

Various woody biomass types and forms can be used. Biomass can be, but is not limited to, any lignocellulosic material, including, but not limited to, wood (such as hardwood or softwood), wood flour, wood chips, slash or other forestry residuals, waste tree slash or trimmings (such as from forest fire control practices), sawdust or other sawmill residuals, paper production wastes or derivatives, lumber production wastes or derivatives, agricultural or other lignocellulosic wastes or derivatives, short rotation or other trees, energy or other crops, or rapidly renewable sustainable biomass, such as poplar, pine, willow, grasses, hemp, and bamboo. Lignocellulosic biomass comprised of softwood (such as pine or various conifers) may be used in various embodiments to produce Hydrophobic Biohydrocarbon compositions with increased energy content.

Biomass can be sized to various sizes and geometries ranging from fine wood flour to larger particles or wood chips with sizing similar to that commonly used in wood pulping paper processes. The biomass does not need to be fully dried and can be processed with its natural moisture content, thereby offsetting virgin water requirements for the disclosed production processes.

B. First Stage of Production Process: Conditioning and Fractionation

The first stage 12 of the disclosed production process is carried out in one or more vessels, in batch or continuous configuration, at temperatures ranging from 100° C. to 400° C., and pressures ranging from subcritical to supercritical.

Different solvents have different solvation properties for different biomass derived solvates. Thus, a mixture of primary hydrophobic solvents and water are blended together to form a multiphase solvent solution at inception ("MSS"). Secondary hydrophobic solvents or hydrophobic solvent blends can also be included in the MSS to ensure completion of the stated first stage objectives. Suitable hydrophobic solvents include, but are not limited to, hydrophobic lignocellulosic biomass derivatives, ethanol, butanol, hexanol, hexane, heptane, methanol, pentanol, toluene, turpentine, carbon tetrachloride, chloroform, methylene chloride, ethyl ether, cyclomethone, dimethacone, vegetable or other oils, terpenes, butyl or other acetates, butyl or other esters, organic furans, fatty acids, oleoresins, rosins, terpenes, gasoline, diesel fuel, naphthalene, one or more derivatives of one or more of the foregoing, or combinations thereof.

Some embodiments facilitate removal of hydrophobic biomass derivatives that inhibit downstream component conversion. For example, in one embodiment, two or more hydrophobic solvents are blended with polar water, including hydrophobic non-polar solvents that have a lower boiling or vaporization point than the multiple chemicals within the Hydrophobic Biohydrocarbon, where at least one hydrophobic non-polar solvent forms an emulsion or becomes miscible with polar water at elevated temperature or pressure, but then becomes immiscible in water under atmospheric conditions. The biomass is then mixed with the MSS, typically at ratios ranging from 1:1 to 1:20 (biomass to MSS) depending on the type and size of the biomass input, to form a mixture referred to herein as the biomass multiphase mixture ("BMM"). If a continuous pipe reactor is used, then the biomass particle size maybe smaller as to allow for high pressure and other pumping of the BMM. The BMM is then placed into the reactor with sufficient heat and pressure to convert at least a portion of the hemicellulose fraction into various biochemicals (such as organic furans) and depolymerize at least a portion of the lignin fraction into various hydrophobic biopolymers (such as phenolic monomers and oligomers) that will be further processed and separated downstream within the process. Likewise, hemicellulose, lignin, and extractive components of the source biomass decompose into three distinct groups: water soluble, water insoluble hydrophilic, and hydrophobic. The lignin fraction of the feedstock is further fractionated into water soluble, water insoluble hydrophilic, and hydrophobic fractions during this stage. The hydrophobic group includes hemicellulose derivatives, such as furfural, HMF, and other organic furans, lignin derivatives, such as resulting from depolymerization to various phenolic monomers and oligomers, and extractive derivatives. The cellulose fraction of the source biomass is water insoluble and hydrophilic, and does not dissolve into the water or hydrophobic solvent fractions of the BMM.

This first stage 12 of the process continues until at least a portion (and in some embodiments substantially all) of the linkages between cellulose, hemicellulose, and lignin are severed and fractionated into substantially water soluble, substantially water insoluble hydrophilic, and substantially hydrophobic fractions, and the substantially hydrophobic fraction has undergone sufficient depolymerization or other reactions to facilitate formation of precursors to the inventive Hydrophobic Biohydrocarbon and HBS compositions.

Significantly, the foregoing severance aspect of the disclosed process has the effect of "disinhibiting" or conditioning and fractionating the cellulose, hemicellulose, lignin, and extractive fractions for downstream reaction, separation, removal, and subsequent conversion of and into their respective Hydrophobic Biohydrocarbon, HBS, and Cellulosic Biopolymer derivatives. The depolymerization and selective solubilization of various water soluble, water insoluble hydrophilic, and hydrophobic biomass derivatives in the BMM under the foregoing temperature and pressure conditions is also directed to facilitate downstream separation and removal of (1) water soluble and water insoluble hydrophilic compounds and other impurities that inhibit downstream reaction, separation, removal, and conversion of the Hydrophobic Biohydrocarbon and HBS; and (2), hydrophobic compounds and other impurities that inhibit downstream conversion (such as by enzymatic hydrolysis) of the Cellulosic Biopolymer, such as vanillin, syringaldehyde, 4-hydroxybenzoic acid, trans-cinnamic acid, p-coumaric acid, ferulic acid, and other hydrophobic hemicellulose, lignin, and extractive derivatives.

Upon output from the first stage of the disclosed production process, the "disinhibited" (conditioned and fractionated) BMM stream is conducted to the second production process stage for removal and production of the inventive Cellulosic Biopolymer compositions by means of filtration, centrifugal processing, or decanters. From there, the BMM stream is conducted directly to the third stage in the process, or back to the head of this first stage for further processing with new feedstock, or for use as the sole feedstock in a substantially identical process to this first stage for additional conditioning of hemicellulose, lignin, or extractive derivatives, such as by depolymerization, modification, or other reactions, with or without one or more additives, to optimize Hydrophobic Biohydrocarbon or HBS compositions for specific applications.

There are various processes that provide for fractionation of cellulose and lignin. U.S. Pat. Nos. 9,365,525 and 9,382,283, which are incorporated by reference herein in their entirety, teach separation of lignin from cellulose to create a "lignin product" that is used as a plastic filler to impart color into plastics. In the U.S. Provisional Application entitled Catalyst Free Organosolv Process, System and Method for Fractionation of Lignocellulosic Materials and Bioproducts, which is incorporated by reference herein in its entirety, a butanol organosolv process is used in a "catalyst free" system for biorefining that provides a meltable lignin-based material. In contrast to the presently disclosed Hydrophobic Biohydrocarbon compositions, each of these processes teach a meltable lignin with a very low melting point, no melt strength, and high levels of impurities that are problematic in downstream biopolymer applications. Likewise, U.S. Provisional application Ser. No. 16/119,030 entitled Method for Separating and Recovering Lignin and Melt Flowable Biolignin Polymers, filed by David Winsness and Riebel (co-inventors of the present patent application), which is incorporated by reference herein in its entirety, teaches of processing to create a melt flowable biopolymeric lignin with higher melting points, higher purity, and improved viscosity sufficient for fiber extrusion, in part based on devolatilization processes.

Each of these processes leave high levels of water soluble, hydrophilic, hydrophobic, and other impurities in the lignin derivative fraction, such as pyrolytic sugars, polymeric inhibitors, and other impurities that frustrate commercial, such as by creating limitations during downstream conversion processes to create renewable fuels and other products. These processes are also limited to using butanol as the primary starting solvent and lack the benefit of using different solvents with different solvation properties for different biomass derived solvates, such as the ability of the presently disclosed compositions and methods to simultaneously produce substantially hydrophilic and impurity free Hydrophobic Biohydrocarbon compositions and substantially hydrophobic and impurity free water insoluble Cellulosic Biopolymer compositions from biomass, including, but not limited to, biomass containing high concentrations of wood extractives, such as pine or various softwoods. Significantly, the foregoing four patents and applications are directed to producing pulp, sugar, and ethanol from biomass, leaving lignin and other feedstock derivatives as byproducts, and therefore lack the additional composition-specific processing steps and other disclosures that achieve the presently disclosed Hydrophobic Biohydrocarbon and HBS compositions, such as the various stages summarized above, or a single integrated process for production and conversion of the inventive Hydrophobic Biohydrocarbon and Cellulosic Biopolymer compositions into the Hydrophobic Biohydrocarbon Fuels, Hydrophobic Biohydrocarbon Products, Cellulosic Biopolymer Fuels, and Cellulosic Biopolymer Products, thereby enabling broad market adoption.

In further contrast to the foregoing four patents and applications, the presently described and claimed methods provide for the usage of different blends of various non-polar hydrophobic solvents and solvent blends with water under heat and pressure to form a more miscible or emulsion admixture to more effectively sever at least a portion (and in some embodiments substantially all) of the linkages between cellulose, hemicellulose, and lignin, for removal of cellulose and other water insoluble hydrophilic components, conversion of hemicellulose into hydrophobic derivatives (such as furfural, HMF, other organic furans), depolymerization of lignin, including, without limitation, into phenolic monomers and oligomers, and downstream separation and removal of substantially hydrophobic and substantially hydrophilic fractions. Significantly, the foregoing aspect of the presently disclosed process facilitates the "disinhibiting" or conditioning and fractionation of the cellulose, hemicellulose, and lignin fractions for subsequent separation, removal, and conversion into their respective Hydrophobic Biohydrocarbon, HBS, and Cellulosic Biopolymer derivatives. Further processing during the first production stage can completely depolymerize and convert at least some (and in some embodiments substantially all) of the lignin into various monomers, oligomers, and polymers wherein, in some cases, no natural lignin linkages of any kind are detectable. In addition, the depolymerized lignin derivatives are reacted in situ with other hydrophobic chemicals derived from the biomass to create specific Hydrophobic Biohydrocarbon compositions.

The extractives are also reacted within the first stage of the process. Wood extracts typically comprise various rosins, resin acids, rosin acids, terpenes, fatty acids and more chemicals within the wood extracts of the biomass. These also can undergo reactions with hemicellulose or lignin derivatives to create various esters and other biochemicals. Acids can also be created and reacted during the first stage including, but not limited to acetic acid, formic acid and other acids originally derived from the lignin, extracts, and other portions of the biomass.

In one embodiment of the first stage, a continuous subcritical or supercritical heat and pressure system is used to increase the speed of certain reactions, such as depolymerization. In some cases, as discussed below in the examples, the reaction can take hours, but under certain conditions this reaction time can be reduced to minutes. In some embodiments, the reaction time can be between one and eight minutes while still retaining a high quality Hydrophobic Biohydrocarbon and Cellulosic Biopolymer compositions.

Other standard equipment such as batch reactors also can be used if larger biomass particles or chips are desired as the biomass source. Such equipment is known by those people skilled in the art.

Various other means or methods can initially fractionate or breakdown biomass into a liquid blend. For example, biomass can be placed in a reactor with water and sufficient heat and pressure applied in subcritical processing or supercritical processing for partially or fully converting the solid biomass into an admixture of compounds in liquid form. In other embodiments, the initial stage can be a batch or continuous process wherein the BMM can further processed to optionally include one or more catalysts, ranging from various acids to various traditional metal or mineral catalysts (such as $Ni/SiO_2$) to provide a higher degree of depolymerization within this first step. Subcritical and supercritical $CO_2$ processing can also be included within various embodiments, wherein additional acids maybe also be integrated to condition the biomass or one or more of its derivatives to optimize production of the inventive Hydrophobic Biohydrocarbon and HBS compositions.

Regardless of the specific process conditions, steps, or additives, the first stage of the inventive production methods can involve the conditioning and fractionation of feedstock biomass into (1) Hydrophobic Biohydrocarbon compositions that are substantially not hydrophilic, (2) HBS compositions that are substantially not hydrophilic, and (3) substantially water insoluble and substantially hydrophilic Cellulosic Biopolymer compositions that are Substantially not Hydrophobic.

C. Second Stage of Production Process: Separation and Removal of Cellulosic Biopolymer The second stage 14 of the presently disclosed production process involves the efficient separation and removal of water insoluble hydrophilic Cellulosic Biopolymer components from the BMM, wherein the removed water insoluble hydrophilic Cellulosic Biopolymer components are substantially comprised of hydrolysable anhydroglucose and are substantially free of inhibitory hydrophobic components and other impurities known to contaminate downstream biological and other renewable fuel production processes, thereby forming the presently disclosed Cellulosic Biopolymer compositions for use in subsequent processing into Cellulosic Biopolymer Fuels or Cellulosic Biopolymer Products. The solids comprising the water insoluble hydrophilic Cellulosic Biopolymer components are separated from the BMM liquid by means of filtration, settling, centrifugation, decanting, heating, evaporation, or other processes for separation of liquid and solid phase components. The separated and removed Cellulosic Biopolymer solids can be further washed, such as with water, steam, alcohol, HBS, blends thereof, or other substances, to remove any of the BMM liquids and inhibitory compounds that may remain on the resulting Cellulosic Biopolymer. The resulting BMM stream, which is comprised of a complex admixture of various depolymerized and reacted components of the source biomass feedstock, is routed to the third stage of the presently disclosed production process, and the "disinhibited" and substantially impurity free Cellulosic Biopolymer is now ready for conversion into Cellulosic Biopolymer Fuels or Cellulosic Biopolymer Products in the presently disclosed Cellulosic Biopolymer conversion processes. In various alternative embodiments, the BMM stream can be conducted from the second stage directly to the third stage in the process, or back to the head of the first stage for further processing with new feedstock, or for use as the sole feedstock in a substantially identical process to the first stage for additional conditioning of hemicellulose, lignin, or extractive derivatives, such as by depolymerization, modification, or other reactions, with or without one or more additives, to optimize Hydrophobic Biohydrocarbon or HBS compositions for specific applications.

D. Third Stage of Production Process: Reactive Phase Separation of Hydrophobic Components The third stage 16 of the presently disclosed production process 10 reacts derivatives of hemicellulose (such as organic furans), lignin (such as phenolic monomers and oligomers), and extractives (such as various acids and oleoresins) in the BMM stream provided from the second stage of the presently disclosed production process. The resulting interactions facilitate separation and removal of hydrophilic and hydrophobic biomass derivatives, and enhance separation and removal of inhibitory compounds and other impurities from precursors to the presently disclosed Hydrophobic Biohydrocarbon and HBS compositions, culminating in two liquid streams that are then separated corresponding to each phase (such as by means of filtration, settling, centrifugation, decanting, heating, evaporation, or other processes for separation of multiphase liquid components): (1) an aqueous phase with water soluble and substantially hydrophilic components (such as organic furans, residual sugars, acetic acid, formic acid, residual salts and other substances that would otherwise contaminate the presently disclosed Hydrophobic Biohydrocarbon compositions), and (2) a liquid organic phase with substantially hydrophobic components. For example, in embodiments involving gravimetric separation, the BMM conducted from the second stage is pumped into a settling vessel and allowed to sit for a period of time, wherein the resulting BMM stratifies into two layers, with the liquid organic layer typically forming on top of the aqueous layer. In another example, the temperature of the BMM is increased to or maintained at 80° C. for a period of time prior to separation to facilitate water solubilization or other separation of biomass derivatives which inhibit polymerization or other reactions amongst various hydrophobic derivatives in the liquid organic layer. In various embodiments, the separation and removal of the aqueous phase from the liquid organic phase (such as by means of filtration, settling, centrifugation, decanting, heating, evaporation, or other processes for separation of multiphase liquid components) facilitates polymerization, cross-linking, or other additional "phase separation" reactions amongst the various components in the liquid organic phase, including amongst hydrophobic derivatives of hemicellulose, lignin, and extractives produced in the first stage that were previously inhibited by the presence of water or other impurities in the BMM stream.

After separation and removal, the aqueous phase may be conducted for treatment to produce a substantially impurity free working solution, which may be routed back to the head of the presently disclosed production process for reuse, with the remaining portion conducted for industrial discharge or other application. After completion of the third stage of the presently disclosed production process, the liquid organic phase with substantially hydrophobic components contains substantially all of the precursor components to the presently disclosed Hydrophobic Biohydrocarbon and HBS compositions, which are then completed, separated, and produced in the following fourth stage of the presently disclosed production process. In various alternative embodiments, the liquid organic phase with substantially hydrophobic components can be conducted from the third stage directly to the fourth stage in the process, or back to the head of the first stage for further processing with new feedstock, or for use as the sole feedstock in a substantially identical process to the first stage for additional conditioning of the precursor components to the presently disclosed Hydrophobic Biohydrocarbon and HBS compositions, such as by depolymerization, modification, or other reactions, with or without one or more additives, to optimize Hydrophobic Biohydrocarbon or HBS compositions for specific applications.

The third stage 16 of the presently disclosed production process can include facilitating separation and removal of hydrophilic and hydrophobic biomass derivatives, as well as other impurities that inhibit downstream component conversion, when (1) at least a portion (and in some embodiments substantially all) of the linkages between cellulose, hemicellulose, and lignin in the biomass were severed and fractionated during the first production stage into substantially hydrophobic and substantially hydrophilic fractions; (2) the substantially hydrophobic fraction has undergone sufficient depolymerization or other reactions during the first production stage to facilitate formation of precursors to the presently disclosed Hydrophobic Biohydrocarbon and HBS compositions; and (3), the BMM conducted from the second stage is comprised of conditioned and fractionated biomass derivatives in an immiscible liquid combination.

E. Fourth Stage of Production Process: Reactive Phase Separation by Molecular Weight The fourth stage 18 of the presently disclosed process conducts the liquid organic phase produced in the foregoing third stage for removal of at least a portion of the low molecular weight liquid phase hydrophobic solvents or hydrocarbons, including, but not limited to, HBS (such as by centrifugation, decanting, heating, evaporation, distillation, or other processes). In some embodiments, the rate and extent of low molecular weight liquid phase component removal can be established to contribute to and complete formation of comparatively higher molecular weight liquid or solid phase Hydrophobic Biohydrocarbon compositions, such as for direct sale as an offset for fossil crude oil or use in subsequent processing and conversion into desired Hydrophobic Biohydrocarbon Fuels or Hydrophobic Biohydrocarbon Products. In various embodiments, the removal of at least some low molecular weight hydrophobic solvents or hydrocarbons (such as by centrifugation, decanting, heating, evaporation, distillation, or other processes) with specific solvation properties for specific solvates facilitates polymerization, cross-linking, or other "phase separation" reactions amongst various precursor components to the presently disclosed Hydrophobic Biohydrocarbon and HBS compositions that were previously dissolved in the liquid organic phase or otherwise "inhibited" by the presence of low molecular weight components commencing immediately after severance, depolymerization, or other production from the source biomass. In additional embodiments, the rate, extent, and number of solvent removal stages (such as by centrifugation, decanting, heating, evaporation, or other processes) may be established to facilitate polymerization, cross-linking, or other "phase separation" reactions, or otherwise contribute to and complete formation of specific Hydrophobic Biohydrocarbon or HBS compositions, such as for specific HBS compositions for direct sale or reuse in the presently disclosed production process, or specific Hydrophobic Biohydrocarbon compositions for direct sale as an offset for fossil crude oil or conversion into specific Hydrophobic Biohydrocarbon Fuels or Hydrophobic Biohydrocarbon Products.

In embodiments of the fourth stage 18 involving reactive phase separation by evaporation, low molecular weight liquid phase hydrophobic solvents or hydrocarbons are removed while leaving relatively higher molecular weight hydrophobic compounds using standard continuous evaporation equipment, twin-screw extruder devolatilization systems, fractional distillation, evaporation tanks or other standard methods of evaporating or combinations thereof, in which gas phase low molecular weight liquid phase hydrophobic solvents (such as HBS) or hydrocarbons are then condensed and recovered to be recycled at the start of the presently disclosed production process. The removal of low molecular weight liquid phase hydrophobic solvents (such as HBS) or hydrocarbons by means of reactive phase separation by evaporation can also have an effect wherein various monomers, oligomers, polymers, and other biomass derivatives within the hydrophobic liquid organic layer contribute to formation of longer chain and higher molecular weight hydrocarbons, thereby contributing to the presently disclosed Hydrophobic Biohydrocarbon compositions.

Prior to the foregoing reactive phase separation process, various embodiments can also include introduction of various additives to the hydrophobic liquid organic layer as to modify the final Hydrophobic Biohydrocarbon product. Various additives include, but are not limited to: organic acids, oils, lipids, free fatty acids, triacylglycerides, hydrocarbons, biomass, carbon black, biochar, various esters, various acetates, other sources of carbon or hydrogen, other functional liquids, plasticizers, crosslinkers, viscosity or other modifiers, nucleating agents, filler materials, or other additives. In addition, various additives added to the liquid organic phase conducted from the third stage prior to the fourth stage can also influence the molecular weights and molecular structures within the Hydrophobic Biohydrocarbon precursor material to impart specific properties that facilitate subsequent processes or otherwise contribute to the presently disclosed Hydrophobic Biohydrocarbon compositions. Various embodiments add such additional materials prior to the fourth stage of the presently disclosed production process; however, some embodiments may include the introduction of additives before, during, or after the first, third, or fourth stages of the process.

The fourth stage may also leave a portion of the primary or secondary hydrophobic solvents (such as HBS) within the Hydrophobic Biohydrocarbon material. The final Hydrophobic Biohydrocarbon composition will either be in a liquid or solid phase based on the amount of remaining solvent or if any additional liquid additives were injected to mix or react within the liquid organic phase produced in the third stage. The solid form of Hydrophobic Biohydrocarbon can be processed through various thermoplastic processing units or processes to further devolatilize the material or melt mix with various other thermoplastics, polymers, resins, fillers, or materials to create a myriad of products. The rheology and viscosity of the final solid phase Hydrophobic Biohydrocarbon based on processing temperatures. In heat processing ranges like that of common thermoplastics, the rheology of Hydrophobic Biohydrocarbon can be similar. If heated higher than 190° C. (to below the vapor point), the Hydrophobic Biohydrocarbon material is liquid and flows easily, making it appropriate for additional downstream processing such as liquid to liquid hydrocracking or fluid cracking processes as to create different renewable fuels or biochemicals.

In another embodiment a purification process is accomplished using the solid form of Hydrophobic Biohydrocarbon in which substantially all the hydrophobic solvent is removed to produce a Hydrophobic Biohydrocarbon composition that is solid phase at room temperature, but that has a melting point around 90° C. In this method, the solid phase Hydrophobic Biohydrocarbon is ground into powder and mixed with water at a temperature between 35° C. and about 80° C. to remove impurities and inhibitory compounds that create problems in downstream hydrocracking into fuel, and that otherwise prevent polymerization of hydrophobic biomass derivatives. The resulting inhibitor free Hydrophobic Biohydrocarbon powder agglomerates to form a homogenous Hydrophobic Biohydrocarbon melt flowable solid upon separation and removal from the heated water, including, in various embodiments, Hydrophobic Biohydrocarbon compositions containing hydrophobic biohydrocarbons with higher average molecular weights than were present in the Hydrophobic Biohydrocarbon compositions prior to the foregoing purification process.

Various other embodiments may involve an initial, subsequent, or different purification step after completion of the fourth production stage to save in overall energy and processing costs, or to otherwise achieve specific Hydrophobic Biohydrocarbon compositions for specific applications. For example, in some embodiments, the Hydrophobic Biohydrocarbon can be conditioned after the fourth production stage to optimize amenability for hydrocracking or other specific renewable fuel conversion by means of one or more purification or washing methods to remove one or more lower molecular weight Hydrophobic Biohydrocarbon constituents to prevent downstream char formation. The foregoing purification or washing methods may include the addition of one or more washing agents, including, but not limited to, any intermediate or other liquid phase stream from the foregoing production process, such as MSS, BMM, or HBS, or virgin alcohols (such as ethanol, methanol, butanol, pentanol, hexanol, or blends thereof), water, or blends thereof, wherein liquid or solid phase Hydrophobic Biohydrocarbon compositions are added and mixed to achieve the desired lower molecular weight Hydrophobic Biohydrocarbon constituent removal. Upon completion of purification or washing, the liquid phase purification or washing solution may be removed (such as by filtration, settling, centrifugation, decanting, heating, evaporation, or other processes for separation of liquid and solid phase components) and conducted to the foregoing first, third, or fourth production stages, or for treatment with one or more other aqueous streams produced by the presently disclosed production process. In still further embodiments, the purification or washing methods may include one or more prior, simultaneous, subsequent, or alternative stages of subcritical or supercritical distillation or other processing to further condition, modify, or fractionate specific Hydrophobic Biohydrocarbon compositions for specific applications. The remaining relatively higher molecular weight Hydrophobic Biohydrocarbon product can be further processed by means of hydrocracking or can be used in various other processes to contribute to or create resins, fuels, plastics, composites, or other polymeric hydrocarbon applications as to provide a carbon negative solution for petroleum applications. Further, in some embodiments of the foregoing purification or washing steps, the interactions with and subsequent removal of the liquid phase purification or washing solution, or the prior, simultaneous, subsequent, or alternative application of heat and pressure in subcritical or supercritical processing, may result in additional chemical or other structural modification of the Hydrophobic Biohydrocarbon, such as additional polymerization, cross-linking, or other "phase separation" reactions amongst at least some Hydrophobic Biohydrocarbon constituents.

Thus, in various embodiments the presently disclosed Hydrophobic Biohydrocarbon compositions may be modified to optimize compositions for one or more specific applications, such as by one or more of the following additional methods: (1) introducing one or more additives during one or more of the first, third, and fourth stages; (2) changing physiochemical process conditions during one or more of the first, third, and fourth stages; or (3), introducing additional processing steps before, during, or after one or more of the first, third, and fourth stages.

The Hydrophobic Biohydrocarbon compositions resulting from the fourth stage of the production process are comprised of a complex admixture of various depolymerized or reacted components from the source biomass feedstock, including, at least in part, a mixture of "disinhibited" (substantially free of hydrophilic components and other impurities) mixed molecular weight hydrophobic hydrocarbons, such as biomass derived biopolymers (such as monomeric, oligomeric, and polymeric phenols), furans, extracts, esters, acetates, residual acids, and other components, which collectively form an alternative to fossil fuel derived petroleum crude oil for use in the production of renewable fuels, chemicals and other materials commonly derived from petroleum crude.

F. Significance of Inhibitor Removal

It is desirable to create the highest utilization and conversion of biomass into multiple liquid fuels. The removal of inhibitors from each fraction disclosed herein is important for full and efficient utilization of biomass, and it imparts each of the presently disclosed compositions with unique benefits. For example, the unique Hydrophobic Biohydrocarbon could not exist or be converted into renewable fuels unless pyrolytic sugars and other hydrophilic components are stripped in the presently disclosed production process. Likewise, the Cellulosic Biopolymer is unique, at least in part, because all key enzyme inhibitors (primarily hydrophobic biomass derivatives) have been substantially removed by the BMM during conditioning and fractionation in the first stage.

In another example, lignin is known to depolymerize and solubilize to release phenolic compounds that would inhibit enzymatic conversion of the Cellulosic Biopolymer, such as vanillin, syringaldehyde, 4-hydroxybenzoic acid, trans-cinnamic acid, p-coumaric acid, and ferulic acid. Phenols have been shown to be strong inhibitors to enzymatic hydrolysis, such as in documented cases of vanillin contamination at 10 mg/ml decreasing cellulose conversion by 50% as compared to the control without vanillin. Non-productive bindings of cellulase and hemicellulase to hydrophobic lignin derivatives are known to decrease enzyme activities. It has also been found that p-courmaric acid and ferulic acid were shown to reduce cellulose conversion to glucose by around 30% and 16%, respectively. Likewise, furfural and HMF (furan derivative degradation products of pentoses and hexoses which derive from hemicellulose), among other hemicellulose derivatives, can negatively affect microbial fermentation by inhibiting cell growth and sugar uptake, subsequently decreasing renewable fuel production. Lignocellulosic derivatives are also known to contain aliphatic acids, such as acetic acid, formic acid, and levulinic acid. Acetic acid is formed primarily by hydrolysis of acetyl groups of hemicellulose, while formic acid and levulinic acid arise as acid-catalyzed thermochemical degradation products from polysaccharides. Formic acid is a degradation product of furfural and HMF, while levulinic acid is formed by degradation of HMF. Minor weak acids such as gallic acid, caproic acid, furoic acid, benzoic acid, and vanillic acid, have also been identified in biomass hydrolysates. Low molecular weight organic compounds can be more toxic to microorganisms than high molecular weight compounds and inhibit fermentation. Low molecular weight organic compounds or their salts have been shown to penetrate cell membranes and disrupt the activity of sugar and ion transportation, resulting in growth and performance inhibition. Extractives are also highly hydrophobic and include various known powerful enzyme and other inhibitors. Wood extract is a complex blend of various chemicals including, but not limited to rosin, terpenes, resin acids, fatty acids, sterols, triglycerides, and other chemicals. Notably, synergistic inhibition has been observed between biomass derivatives that decrease more yield and productivity than the additive inhibition of singular compounds. Since lignin-derived compounds are among strong inhibitors of enzymatic reaction and microbial fermentation, delignification process is necessary for improving the cellulose conversion. The presently disclosed production process natively achieves that end by conditioning, fractionating, separating, and removing impurities to form each of the Hydrophobic Biohydrocarbon, HBS, and Cellulosic Biopolymer compositions.

In some embodiments, the removal of inhibitory compounds is an important aspect of the foregoing production process to enable downstream conversion and broad market adoption of renewable fuels and other alternatives to fossil fuel derivatives from lignocellulosic biomass, in which (1) substantially hydrophobic relatively higher molecular weight biomass derivatives are substantially freed of hydrophilic components and other impurities to produce the presently disclosed Hydrophobic Biohydrocarbon compositions, (2) substantially hydrophobic relatively lower molecular weight biomass derivatives are substantially freed of hydrophilic components and other impurities to produce the presently disclosed HBS compositions, and (3) substantially hydrophilic water insoluble biomass derivatives are substantially freed of hydrophobic components and other impurities to produce the presently disclosed Cellulosic Biopolymer compositions.

G. Modification

In embodiments involving modification to optimize the presently disclosed Hydrophobic Biohydrocarbon compositions for one or more specific applications, one or more of the following additional methods may be used: (1) introducing one or more additives before, during, or after one or more of the first, third, or fourth stages of the presently disclosed Hydrophobic Biohydrocarbon production process; (2) changing physiochemical process conditions during one or more of the first, third, or fourth stages of the presently disclosed Hydrophobic Biohydrocarbon production process; or (3), introducing additional processing steps before, during, or after one or more of the first, third, or fourth stages of the presently disclosed Hydrophobic Biohydrocarbon production process.

The disclosed Hydrophobic Biohydrocarbon compositions readily react (during or after the one or more of the first, third, and fourth stages of the inventive production process), with various resource donors, such as organic acids, oils, lipids, free fatty acids, triacylglycerides, hydrocarbons, biomass, carbon black, biochar, various esters, various acetates, or other sources of carbon or hydrogen, to provide enriched mixtures for conversion. For example, lipids, free fatty acids, or triacylglycerides are admixed before, during, or after one or more of the first, third, and fourth stages of the inventive production process to facilitate favorable in situ reactions, such as depolymerization, esterification, or acetylation, to produce Hydrophobic Biohydrocarbon mixtures with reduced organic oxygen, increased hydrogen or energy content, or increased carbon-carbon coupling or molecular weights.

In embodiments involving modification by introducing one or more additives to optimize the presently disclosed Hydrophobic Biohydrocarbon compositions for one or more specific applications, including, but not limited to, the Hydrophobic Biohydrocarbon Fuels and Hydrophobic Biohydrocarbon Products disclosed herein, other liquid and solid phase fuel precursors or products, plastics, polymers, elastomers, coatings, composites, resins, carbon fiber, graphite, other petrochemical offsets, or other applications, the one or more additives may include various additives, such as organic acids, oils, lipids, free fatty acids, triacylglycerides, hydrocarbons, biomass, carbon black, biochar, various esters, various acetates, other sources of carbon or hydrogen, other functional liquids, plasticizers, crosslinkers, viscosity or other modifiers, nucleating agents, filler materials, or other additives.

In embodiments involving production of Hydrophobic Biohydrocarbon compositions for conversion into specific renewable fuels, one or more hydrogen donors may be introduced before, during, or after the Hydrophobic Biohydrocarbon production process disclosed herein, in which the one or more hydrogen donors may include, without limitation, hydrogen, hydrogen peroxide, ammonia, acid (such as formic, oxalic, citric, various organic or other acids, or combinations thereof), alcohol, HBS or other hydrocarbons, or combinations thereof, for the purpose of decreasing organic oxygen, increasing hydrogen or energy content, or increasing carbon-carbon coupling or molecular weights of the resulting Hydrophobic Biohydrocarbon composition; which, in various embodiments, may offset the need for pure hydrogen use during downstream conversion into Hydrophobic Biohydrocarbon Fuels or Hydrophobic Biohydrocarbon Products, or otherwise optimize the resulting Hydrophobic Biohydrocarbon composition for conversion.

Various alcohols may be added before, during, or after Hydrophobic Biohydrocarbon formation to assist in subsequent conversion, including, but not limited to, isopropyl, ethanol, methanol, butanol, glycols, glycerin, or combinations thereof, in which the extent and rate of addition may be established to produce Hydrophobic Biohydrocarbon compositions with favorable specifications for conversion into specific Hydrophobic Biohydrocarbon Fuels or Hydrophobic Biohydrocarbon Products. Likewise, in other embodiments, various other substances can be added before, during, or after one or more stages of the presently disclosed Hydrophobic Biohydrocarbon production process to facilitate polymerization, cross-linking, or other additional reactions amongst one or more Hydrophobic Biohydrocarbon or HBS precursors, constituents, or derivatives, such as organic acids, oils, lipids, free fatty acids, triacylglycerides, hydrocarbons, biomass, carbon black, biochar, various esters, various acetates, other sources of carbon or hydrogen, other functional liquids, plasticizers, crosslinkers, viscosity or other modifiers, nucleating agents, filler materials, or other additives, or combinations thereof.

The use of one or more of the foregoing or other additives can also influence the molecular weights and molecular structures within Hydrophobic Biohydrocarbon as it forms to impart specific properties that facilitate production or otherwise contribute to the presently disclosed Hydrophobic Biohydrocarbon compositions. The use of additives in such and other embodiments can also modify the Hydrophobic Biohydrocarbon as it forms to optimize its characteristics for a specific downstream conversion process, such as the HP Fuel conversion methods disclosed herein, extrusion, pyrolysis, carbonization, graphitization, or other conversion methods.

Carbon black and other forms of high carbon materials can be added to the organic liquid phase before, during or after the first, third, or fourth stages of the disclosed production process, in which the carbon black is a reactant in esterification, polymerization, cross-linking, or other reactions before, during, or after solvent removal, resulting in a homogenous Hydrophobic Biohydrocarbon material. For example, carbon black was added prior to completion of the fourth stage of the presently disclosed production process to facilitate esterification, polymerization, cross-linking, or other additional reactions amongst one or more Hydrophobic Biohydrocarbon or HBS precursors, constituents, or derivatives, yielding a unique new homogenous Hydrophobic Biohydrocarbon composition characterized by a mixture of higher molecular weight hydrophobic hydrocarbons, a substantially increased boiling point, increased overall energy content, and other specifications favorable to conversion into Hydrophobic Biohydrocarbon Fuels. In another example, the inventors have demonstrated use of several of the foregoing additives in the formation of various Hydrophobic Biohydrocarbon Products comprised of unique new forms of melt flowable and other lignocellulosic biomass derived crystalline carbon materials, including, without limitation, Hydrophobic Biohydrocarbon Products amenable for conversion into biomass derived graphite.

In another example, solid phase Hydrophobic Biohydrocarbon was produced from the fourth stage of the presently disclosed production process, ground into a powder, and mixed with water at 80° C. The Hydrophobic Biohydrocarbon powder reformed into a homogenous liquid phase composition before separation and cooling, at which point it reformed into a melt flowable solid phase Hydrophobic Biohydrocarbon composition characterized by a mixture of higher molecular weight hydrophobic hydrocarbons and an increased boiling point. A variation of the foregoing example involved the replacement of water with methanol at a temperature slightly less than the boiling point of methanol, which dissolved a portion of the powder while the remaining powder aggregated and formed a homogenous solid phase Hydrophobic Biohydrocarbon composition upon removal from solution and cooling, in which the solid phase Hydrophobic Biohydrocarbon composition was characterized by a mixture of higher molecular weight hydrophobic hydrocarbons and an increased boiling point. In another variation of the foregoing example, carbon black was added to and mixed with the water solution at 80° C., yielding a single homogenous solid Hydrophobic Biohydrocarbon composition upon removal and cooling, in which the solid phase Hydrophobic Biohydrocarbon composition was characterized by a mixture of higher molecular weight hydrophobic hydrocarbons and an increased boiling point.

Hydrophobic Biohydrocarbon Compositional Characteristics

The Hydrophobic Biohydrocarbon compositions disclosed herein derive from lignocellulosic biomass and have unique characteristics. In some embodiments, Hydrophobic Biohydrocarbon is comprised of a mixture of mixed molecular weight hydrophobic hydrocarbons that are substantially free of hydrophilic components and impurities, and amenable for use as a renewable alternative to fossil fuel derived petroleum crude oil. In various additional embodiments, Hydrophobic Biohydrocarbon may include melt flowable solid phase hydrophobic hydrocarbon compositions that can be converted upon thermalization into liquid with unique rheology characterized by nonlinear viscosity, thereby facilitating conversion into various renewable fuels and other alternatives for fossil fuel derivatives, including, without limitation, the Hydrophobic Biohydrocarbon Fuels and Hydrophobic Biohydrocarbon Product disclosed herein. In such and other embodiments, solid phase Hydrophobic Biohydrocarbon compositions exhibit unique structural properties, such as formation of conchoidal fractures and other properties not typically displayed by known lignocellulosic biomass derivatives. In various other embodiments, the presently disclosed Hydrophobic Biohydrocarbon compositions are characterized by a mixture of mixed molecular weight substantially hydrophobic hydrocarbons that are substantially free of hydrophilic components and impurities, in which the mixed molecular weight substantially hydrophobic hydrocarbons include monomeric, oligomeric, or polymeric hydrocarbons, including, without limitation, aromatic or aliphatic hydrocarbons that are collectively further characterized by the amount and proportion of carbon (at least 50% by weight), hydrogen (at least 4% by weight), and oxygen (less than 40% by weight), with a collective sulfur content of less than 4% by weight, and a collective energy content of no less 11,000 BTU per pound (corresponding to about 60% of the energy content of petroleum crude oil). As disclosed in the examples below, the Hydrophobic Biohydrocarbon can have a carbon content of between 50% by weight and 90% by weight, a hydrogen content of between 4% by weight and 20% by weight, an oxygen content of 0% by weight to 40% by weight), with a collective sulfur content of 0% by weight to 4% by weight, and a collective energy content of 11,000 BTU per pound to 20,000 BTU per pound. In various embodiments involving the foregoing composition, Hydrophobic Biohydrocarbon additionally contains one or more hydrophobic hydrocarbon "markers" deriving from lignocellulosic biomass, such as butyl acetate, butyl ester, one or more other acetates or esters, or substantially melt flowable aromatic or aliphatic hydrocarbons.

In addition, biobased or biogenic feedstocks can be identified reliably through radiocarbon dating and methods comparing blending amounts of fossil carbon with renewable carbon in a sample, such as is described in ASTM D6866. Lignocellulosic biomass contains a known amount of Carbon-14 ("C14") that is carried over into its various derivatives, including Hydrophobic Biohydrocarbon. In contrast, fossil fuels do not contain any C14, and since the amount of C14 in biomass is known, a percentage of carbon from renewable sources can be easily calculated, and therefore provide a ready means of confirmation for application of subsidies, credits, and other low carbon attributes.

HBS Compositional Characteristics

The HBS is a complex admixture of compounds of various molecular weights, such as ketones, esters, acids, aldehydes, alcohol, ether and organic furans. The ratios of these components can vary based on the type of woody biomass feedstock, pH, and other process conditions such as heat and temperature. In various embodiments, HBS is made up of hydrophobic biosolvents from lignocellulosic biomass, such as butyl acetate, butyl ester, oleoresins, organic furans, fatty acids, rosins, terpenes, wood extracts, hemicellulose derivatives, such as furfural, methylfurfural, hydroxmethylfurfural, and ethoxymethylfurfural, and one or more derivatives of one or more of the foregoing, for use in providing the presently disclosed Hydrophobic Biohydrocarbon hydrophobic biohydrocarbons and Cellulosic Biopolymer hydrophilic biopolymers. Furfural readily dissolves in most polar solvents, but is only slightly soluble in water, and participates in the same kinds of reactions as other aldehydes and other aromatic compounds. It exhibits less aromatic character than benzene, as can be seen from the fact that furfural is readily hydrogenated to tetrahydrofurfuryl alcohol. When heated in the presence of acids, furfural irreversibly polymerizes, acting as a thermosetting polymer. The combination of biomass derived furfural, acids, and phenolic compounds assists in the creation of the novel Hydrophobic Biohydrocarbon material characteristics. In additional embodiments, HBS is comprised of various esters, organic furans, acids, ethers, alcohols, ketones, or other components at ratios that may be determined by the selecting the type and quantity of biomass used as a feedstock. In further embodiments, HBS is primarily comprised of derivatives of butanol, hemicellulose, or extractives. Feedstocks containing higher concentrations of wood extractives in further embodiments can produce higher levels of various esters which contribute to the HBS composition, such as butyl acetate, butyl formate, butyl lactate, butyl levulinate, butyl glycolate, butyl propanoate, butyl acrylate, and butyl butanoate, as well as methyl propionate, methyl acetate, and similar compounds. The production and presence of such esters in HBS contributes to depolymerization, fractionation, and other Hydrophobic Biohydrocarbon production process efficiency as compared to the use of alcohol alone, such as butanol. Advantageously, and in further contrast to known processes, while one or more HBS components can be sourced from virgin raw materials, one or more HBS components can be co-produced in situ during Hydrophobic Biohydrocarbon production from fractions of the input biomass that do not convert to Hydrophobic Biohydrocarbon, and that are then separated from Hydrophobic Biohydrocarbon and reserved for reintroduction and use in subsequent Hydrophobic Biohydrocarbon production. Thus, for every cycle of the presently disclosed Hydrophobic Biohydrocarbon production process disclosed herein, more HBS is generated, resulting in a "self-generated" HBS gain that may exceed 5% by weight of the starting solvent input into the first stage of the presently disclosed production process.

Cellulosic Biopolymer Compositional Characteristics

The Cellulosic Biopolymer is a substantially hydrophilic biopolymer from lignocellulosic biomass that is substantially free of hydrophobic hydrocarbons and other impurities known to contaminate downstream biological and other renewable fuel production processes. In some embodiments, the Cellulosic Biopolymer is insoluble in water and comprised, at least in part, of hydrolysable anhydroglucose, for use in producing fermentable sugars (such as glucose) and fermentation products (such as acetic acid, ethanol, butanol, fatty acids, lipids, or triacylglycerides) and other renewable alternatives to fossil fuels, fossil fuel derivatives, and other products.

Detailed Description of Hydrophobic Biohydrocarbon Conversion Processes

The Hydrophobic Biohydrocarbon product produced in the fourth stage of the foregoing presently disclosed production process is conducted in various embodiments for fluid cracking, hydrocracking, or other processes to create reduced carbon, carbon neutral, and carbon negative renewable fuels and other alternatives to fossil fuel derivatives, such as renewable diesel fuel, sustainable aviation fuel, gasoline, marine fuel, biopolymers, bioplastics, biocomposites, and biochemicals.

In some embodiments involving Hydrophobic Biohydrocarbon conversion into renewable fuels, the Hydrophobic Biohydrocarbon is subjected to catalytic hydroprocessing in the presence of hydrogen and one or more catalysts to yield a hydroprocessing product comprising hydrocarbons having a compositional or molecular weight distribution analogous to conventional liquid fuels deriving from fossil petroleum. In embodiments involving solid phase Hydrophobic Biohydrocarbon, the Hydrophobic Biohydrocarbon may be heated prior to hydroprocessing to reach the desired viscosity for hydrocracking.

The amount of hydrogen gas needed for the various hydroprocessing reactions depends on the amount and type of the feed material and process conditions. Catalytic hydroprocessing may be carried out in one stage where hydrodeoxygenation and hydrodewaxing are carried out in a hydroprocessing reactor system comprising one or more reactors. Alternatively catalytic hydroprocessing may be realized in at least two stages, such as a hydrodeoxygenation first stage followed by a hydrodewaxing or hydroisomerization second stage in two or more reactors. In catalytic hydroprocessing the Hydrophobic Biohydrocarbon catalyst can be any catalyst known in the art, suitable for the removal of heteroatoms from organic compounds (such as oxygen, sulfur, or nitrogen). In one embodiment, the catalyst is selected from a group consisting of nickel molybdenum (NiMo), cobalt molybdenum (CoMo), or a mixture of cobalt, molybdenum, and nickel. NiMo catalysts known to be very efficient in such applications. In addition, the catalyst may be a supported catalyst comprised of any oxide which is typically used in the art, such as aluminum oxide (Al2O3), silicon dioxide (SiO2), zirconium dioxide (ZrO2), activated carbon, or zeolites, such as zeolites comprised at least in part of aluminum or silicon, or mixtures thereof.

The Hydrophobic Biohydrocarbon compositions provided for fluid cracking or hydrocracking into a liquid fuel or liquid fuel component can be comprise Hydrophobic Biohydrocarbon, Hydrophobic Biohydrocarbon with residual HBS, or Hydrophobic Biohydrocarbon that has been fractionated, purified, or washed after production in the fourth stage of the presently disclosed production process to remove relatively low molecular weight Hydrophobic Biohydrocarbon constituents or other conversion impurities, and produce relatively higher molecular weight Hydrophobic Biohydrocarbon compositions for conversion.

In one embodiment the Hydrophobic Biohydrocarbon material is subjected to a hydroprocessing reaction that includes two sequential hydroprocessing treatments, which can be performed as a single operation in a series flow reactor, with or without a solvent. In the first hydroprocessing treatment, the Hydrophobic Biohydrocarbon feed is subjected to hydrodeoxygenation to yield hydrodeoxygenated products. In the immediately following second hydroprocessing treatment, the hydrodeoxygenated product from the foregoing hydrodeoxygenation treatment is subjected to partial ring hydrogenation and mild hydrocracking to produce the final reformulated hydrocarbon fuel. In various embodiments, the hydrocracking process can be established, modified, or optimized to produce specific renewable fuels or other lignocellulosic biomass derived hydrocarbons, such as renewable diesel fuel, sustainable aviation fuel, naphtha, and residual carbon pitch.

In one embodiment, the first and second hydroprocessing treatments are carried out in a temperature range from about 350° C. to about 390° C. to produce a fuel product including a well-balanced mixture of the following three types of hydrocarbons (1) monoalkyl, dialkyl, trialkyl, and tetraalkyl substituted cyclohexanes and cyclopentanes; (2) monoalkyl, dialkyl, trialkyl, and tetraalkyl substituted benzenes; and (3), Cs—C multi branched paraffins. The hydrodeoxygenation step in the hydroprocessing treatment of the second stage of the foregoing conversion process is performed using a hydride oxygenation catalyst, such as a sulfide CoMo $Al2O_3$ catalyst system, at a temperature range of about 350° C. to about 390° C. and a hydrogen pressure ranging from about 1,400 psig to 2,200 psig.

In one embodiment a CoMo Al2O3 catalyst includes about 2% to about 6% by weight of cobalt and about 7% to about 10% by weight molybdenum. For a feed obtained in the presence of methanol as reaction medium, the light hydrodeoxygenated oil product obtained by the hydrodeoxygenation step can primarily include a mixture of toluene, ethylbenzene, xylene, trimethylbenzene, ethylmethylbenzene, or C-alkylbenzenes (C-alkyl indicating the total number of carbons in 1 to 4 alkyl substituents). Prominently absent in the hydrodeoxygenation product mixture is benzene, which is an undesirable carcinogenic that may be typically present in aromatic hydrocarbons.

Supplemental mild hydrocracking and partial ring hydrogenation treatments of the intermediate hydrodeoxygenation product in the hydroprocessing treatment is performed in the presence of a catalyst, such as sulfide metal promoted catalyst system involving aluminum or silicon oxides with chromium, cobalt, copper, iridium, iron, molybdenum, nickel, palladium, platinum, tungsten, or rhenium, rhodium, ruthenium, or combinations thereof. Other suitable catalyst systems are disclosed in the following two articles, the entire disclosures of which are incorporated herein by reference: Shabtai, Catalytic Functionalities of Supported Sulfides, IV C—O Hydrogenolysis Selectivity as a Function of Promoter Type, J. Catal. 104: 413-423 (1987); and Shabtai, J. et al., Catalytic Functionalities of Supported Sulfides, V C—N Hydrogenolysis Selectivity as a Function of Promoter Type, J. Catal. 113: 206-219 (1988). Corresponding catalyst systems supported on aluminum or titanium oxides are also effective for the hydrocracking treatment step. The processing conditions for the hydrocracking treatment step of the intermediate hydrodeoxygenation product include a temperature in the range of about 350° C. to about 390° C., and a hydrogen pressure in the range of about 1,400 psig to 2,800 psig, or about 2,200 psig to 2,800 psig.

In another embodiment, an additional fluid is introduced to modify viscosity or otherwise assist in the hydrocracking process that facilitates contact between the Hydrophobic Biohydrocarbon and one or more catalysts, such that the fluid wets the catalyst and facilitates conveyance of Hydrophobic Biohydrocarbon to, into, and through catalyst pores while being a carrier for hydrogen for the conversion reaction. After preheating with liquid or in a liquid phase, Hydrophobic Biohydrocarbon is hydrotreated to decarboxylate and remove oxygen for partial cracking of higher molecular weight components into lower molecular weight components, such as components comprising an aromatic ring or naphthene. Decarboxylation minimizes hydrogen consumption in breaking bonds holding the aromatic units in various Hydrophobic Biohydrocarbon components together, while limiting the amount of hydrogenation of the aromatic rings to naphthenes.

Another embodiment includes a cracking function, in which a zeolite, amorphous silica-alumina catalyst, one or more other catalysts, or a combination of any two or more of the foregoing is used and includes one or more deposited metals selected from chromium, cobalt, copper, iridium, iron, molybdenum, nickel, palladium, platinum, tungsten, or rhenium, rhodium, ruthenium, or combinations thereof. In one embodiment, the catalyst includes a mixture of deposited molybdenum and nickel, in which the catalyst can contain large pores providing for sufficient sizing and surface area to admit larger feedstock derived molecules into the pores for cracking into smaller molecular weight components. The deposited metals on the catalyst typical ranges from 0.1% to 20% by weight, with metals and values including, but not limited to, nickel in a range from 0.5% to 10% by weight, tungsten in a range from 5% to 20% by weight, and molybdenum in a range from 5% to 20% by weight. The metals can also be deposited in combinations on the catalyst with combinations, in some embodiments, being nickel with tungsten or molybdenum. Zeolites used for catalysts include, but are not limited to, beta zeolite, Y-zeolite, MFI type zeolites, mordenite, silicalite, SM3, and faujasite. Suitable catalysts include hydrocracking catalysts, hydrotreating catalysts, and mixtures of hydrocracking and hydrotreating catalysts.

In various hydrocracking, hydrotreating, and other conversion embodiments it is common to transfer the resulting product for further refinement in fractional distillation processes, in which mixtures of various chemical compounds are separated by heating them to a temperature in which one or more fractions of the mixture will vaporize. The input components to such processes typically have boiling points that differ by less than 25° C. from each other under a pressure of one atmosphere. For example, fractional distillation is used in oil refineries to separate petroleum crude oil into various fractions based on their respective molecular weights and boiling points. Substantially similar processes are used to fractionate Hydrophobic Biohydrocarbon derivatives in some embodiments involving production of Hydrophobic Biohydrocarbon Fuels or Hydrophobic Biohydrocarbon Products from the presently disclosed Hydrophobic Biohydrocarbon compositions disclosed herein, in which the resulting Hydrophobic Biohydrocarbon Fuel or Hydrophobic Biohydrocarbon Product fractions with higher boiling points are characterized by more carbon atoms, higher molecular weights, less branched chain alkanes, darker color, increased viscosity, and higher ignition points.

Fractional distillation can also be applied to liquid phase HBS-Hydrophobic Biohydrocarbon or Hydrophobic Biohydrocarbon compositions prior to hydrocracking, hydrotreating, and other conversion embodiments, to produce specific fractional compositions for conversion into Hydrophobic Biohydrocarbon Fuels or Hydrophobic Biohydrocarbon Products. In various embodiments involving fractional distillation of liquid phase HBS-Hydrophobic Biohydrocarbon or Hydrophobic Biohydrocarbon compositions, one or more higher molecular weight fractions may be routed for hydrocracking, hydrotreating, and other conversion methods into one or more specific Hydrophobic Biohydrocarbon Fuels or Hydrophobic Biohydrocarbon Products, while one or more lower molecular weight fractions may be conducted for dedicated conversion into one or more specific Hydrophobic Biohydrocarbon Fuels or Hydrophobic Biohydrocarbon Products, or for use as a blend stock prior to, during, or after one or more of the first, third, or fourth stages of the presently disclosed production processes disclosed herein, or recycled back to the inlet of the hydrocracking, hydrotreating, and other conversion methods. The resulting liquid Hydrophobic Biohydrocarbon Fuel product includes fuel grade hydrocarbons conforming to the specifications required for liquid fuels, such as a boiling point of between 190° C. and 380° C. A person skilled in the art will be able to vary the foregoing process conditions to change the temperature cut point as desired to obtain suitable Hydrophobic Biohydrocarbon Fuel or Hydrophobic Biohydrocarbon Product compositions.

In various embodiments, a distillate fraction may be comprised of a hydrocarbon fraction having a boiling point in the conventional diesel fuel range, such as from 160° C. to 380° C., and that otherwise meets the characteristic specifications of renewable diesel fuel. In those and other embodiments, hydrocarbon fractions distilling at temperatures ranging from 40° C. to 210° C. can be recovered for use as renewable alternatives to conventional gasoline or naphtha fuels, or as blending components with and for such fuels. In such embodiments, lighter distillate fractions that are suitable for use as renewable solvents, aviation fuel, or kerosene may be obtained.

The foregoing conversion processes may additionally comprise any conventional steps, such as separation of gases, scrubbing, washing, cooling, filtering, and recovering of intermediates and products, mixing refining or fractionation of effluents. These embodiments can be used in combination with other disclosed embodiments. The process may be batch-type or semi-batch-type or continuous.

Detailed Description of Cellulosic Biopolymer Conversion Processes

The "disinhibited" and substantially impurity free Cellulosic Biopolymer produced in the second stage of the foregoing presently disclosed production process is conducted in various embodiments for enzymatic or other hydrolysis into fermentable sugars, such as glucose, and a solid phase co-product ("hydrolysis solids"). In various embodiments, the hydrolysis solids can be sold for use by third parties, directly used as a feedstock for heat and power production or routed back to the head of the presently disclosed production process for conversion into various biochemicals, hydrophilic biopolymers, or hydrophobic biopolymers. Likewise, the fermentable sugars can be sold for fermentation or other uses by third parties, or directly conducted to fermentation immediately upon production to further produce reduced carbon, carbon neutral, and carbon negative renewable fuels and other products, such as acetic acid, butanol, ethanol, fatty acids, lipids, triacylglycerides, or other fermentation derivatives; for example by use of *Saccharomyces cerevisiae* or wickerhamomyces anomalous to produce ethanol, or by use of *Schwanniomyces occidentalis, Yarrowia lipolytica*, or one or more other oleaginous microbes to produce fatty acids, lipids, or triacylglycerides. In embodiments involving the resulting lignocellulosic biomass derived ethanol ("cellulosic ethanol") conforming, for example, to ASTM D7566 or other applicable standards, one or more additional catalytic or other steps can be immediately applied to convert the cellulosic ethanol into sustainable aviation fuel. Likewise, in embodiments involving the resulting lignocellulosic biomass derived fatty acids, lipids, or triacylglycerides ("cellulosic oil"), one or more additional catalytic or other steps can be immediately applied to convert the cellulosic oil into biodiesel or renewable diesel conforming, for example, to ASTM D6866 or other applicable standards, including, without limitation, separate from or together with at least a portion of the Hydrophobic Biohydrocarbon.

Hydrophobic Biohydrocarbon Fuel and Hydrophobic Biohydrocarbon Product Compositional Characteristics The presently disclosed Hydrophobic Biohydrocarbon can be converted into various "drop in" and other transportation fuels, including renewable diesel and gasoline. Renewable diesel has a similar or substantially similar chemical composition to fossil derived diesel fuel except that it is produced from one or more biomass derived or other renewable feedstocks. Renewable diesel Hydrophobic Biohydrocarbon Fuels produced and converted using the presently disclosed methods disclosed herein are predominately comprised of hydrocarbons (substantially without oxygenates) and meet the requirements for use in a diesel engine, such as fuel specifications which conform to ASTM D6866 or other applicable standards.

Today almost all renewable diesel is produced from animal fats, vegetable oils, and greases ("FOGs"), that vast majority of which are co-produced during the production and use of agricultural and other food products, which in turn provide the primary upper limit on FOG availability for renewable diesel production. The corresponding limitations on supply cause upward pressure on feedstock costs for renewable diesel producers. The presently disclosed Hydrophobic Biohydrocarbon compositions disclosed herein may be used as a substitute for such conventional feedstocks. However, Hydrophobic Biohydrocarbon derives from lignocellulosic biomass, and is therefore a vastly more voluminous renewable feedstock than FOGs. In addition, the presently disclosed Hydrophobic Biohydrocarbon conversion processes disclosed herein provide various methods for improved conversion yields, including, without limitation, emulsification, solvent addition, esterification, various other chemical methods, distillation, hydrocracking, hydrotreatment, steam reforming, or supercritical processing. In various embodiments, Hydrophobic Biohydrocarbon conducted for conversion by deoxygenation or hydrocracking has a high percentage of alcohols, esters, ethers, organic furans with low levels of ketones, and other components that facilitate conversion to Hydrophobic Biohydrocarbon Fuels. Further, in contrast to various conventional renewable feedstocks, Hydrophobic Biohydrocarbon is substantially free of impurities and may be characterized, in various embodiments, by reduced oxygen content in comparison to conventional renewable fuel feedstocks. Hydrophobic Biohydrocarbon oxygen can be further reduced during the presently disclosed production or conversion process(es) by introducing one or more hydrogen donors, such as hydrogen gas or various acids (including, without limitation, formic, citric, oxalic, or methanesulphonic acid). Hydrophobic Biohydrocarbon therefore provides renewable diesel producers with compelling new feedstock options.

The Hydrophobic Biohydrocarbon material can be used in various processes for conversion into polymer products as a reduced carbon, carbon neutral, or carbon negative alternative that, in various embodiments, provides for improved economics as compared to fossil fuel derived products. The presently disclosed Hydrophobic Biohydrocarbon compositions disclosed herein are substantially impurity free and can be produced in a liquid or solid form with thermoplastic characteristics. For most polymer, plastic, or composite Hydrophobic Biohydrocarbon Product applications, it is often desirable for the Hydrophobic Biohydrocarbon material to be in a solid form with thermoplastic characteristics. In other Hydrophobic Biohydrocarbon Product applications such as coatings, binders, and various additive applications it is often desirable to keep Hydrophobic Biohydrocarbon in a liquid form.

Solid phase Hydrophobic Biohydrocarbon has thermoplastic characteristics such as a glass transition point, melting point and rheology that can be adjusted to meet various polymer or plastic applications. In one embodiment, the glass transition can be tuned to 74° C with a rheology of 1000 Pa·s at 131° C. that allow for the extrusion of shapes or fibers for various applications. These characteristics can be modified further by various further processing steps of the Hydrophobic Biohydrocarbon such as purification using water or alcohol, further heat processing, or the addition of various functional additives. For various products the solid form with thermoplastic characteristics provides for a Hydrophobic Biohydrocarbon feedstock material that can be easily modified for various applications by melt mixing or compounding similar to that of petroleum plastics. A solid form of Hydrophobic Biohydrocarbon can be produced from the organic layer or condensed Hydrophobic Biohydrocarbon liquid by means of further evaporation or fractional distillation at higher temperatures to remove lower molecular weight hydrocarbon fractions, such as phenol esters, butyl esters and wood extractive esters. Modification of the Hydrophobic Biohydrocarbon to produce various Hydrophobic Biohydrocarbon Products can be achieved by introducing one or more additives, including, but not limited to, various polyols, acids, crosslinkers, function plastic additives, solvents, alcohols, plasticizers, catalysts, thermoplastics, resins, and other standard additives.

Various applications include, but are not limited to carbon fibers, biographite, plastics, composites, bioplastics, thermoplastic alloys, coatings, adhesives, binders, impregnating resins, foams, and other conventional petrochemical plastics applications.

HP Fuel and HP Product Compositional Characteristics

In some embodiments involving hydrolysis of the Cellulosic Biopolymer to produce glucose and hydrolysis solids, followed by fermentation of the glucose into cellulosic ethanol, the resulting ethanol conforms, for example, to ASTM D4806 standard specification for denatured fuel ethanol for blending with gasoline (fossil or the renewable equivalent). In embodiments involving one or more additional catalytic or other steps to convert cellulosic ethanol into sustainable aviation fuel, the resulting HP Fuel conforms, for example, to ASTM D7566 or other applicable standards. In embodiments involving conversion of Cellulosic Biopolymer derived glucose into cellulosic oil (such as fatty acids, lipids, or triacylglycerides), followed by one or more additional catalytic or other steps to convert cellulosic oil into renewable diesel fuel, the resulting HP Fuel conforms, for example, to ASTM D6866 or other applicable standards.

EXPERIMENTS

The present disclosure is further illustrated by the following examples, in which parts and percentages are by weight and degrees are Celsius, unless otherwise stated. These examples are given by way of illustration only. From the above discussion and these examples, without departing from the spirit and scope thereof, the skilled artisan can make various changes and modifications of the invention to adapt it to various usages and conditions. Thus, various modifications of the invention in addition to those shown and described herein will be apparent to those skilled in the art from the foregoing description. Such modifications are also intended to fall within the scope of the appended claims. The disclosure of each reference set forth herein is incorporated herein by reference in its entirety.

Experiment 1: Production of Hydrophobic Biohydrocarbon

Pinewood was ground into a granular form of a size roughly averaging 0.2" in length. The pine biomass was then placed into a parr reactor vessel. A blend of polar and non-polar hydrophobic solvents was mixed comprising butyl acetate, furfural, and n-butanol, and mixed with water at a 50:50 ratio to form a multiphase solvent solution ("MSS"). Biomass was added to the MSS at a ratio of 10:1 to create a biomass multiphase mixture ("BMM"). The vessel was taken to a temperature of 180° C. and a pressure of 200 psig for 60 minutes and cooled. The BMM within the vessel was then filtered to remove insoluble Cellulosic Biopolymer components, which were then washed to yield a substantially Cellulosic Biopolymer free BMM stream. After cooling to room temperature, the BMM gravity separated into two streams: (1) an aqueous phase with water soluble and substantially hydrophilic components, and (2) a liquid organic phase with substantially hydrophobic components. The aqueous phase was separated and tested to confirm the presence of acetic acid and other water-soluble compounds. The liquid organic phase was tested to confirm the presence of hydrophobic solvent, furfural, HMF, various phenolic compounds, and a mixture of other hydrophobic hydrocarbons evidenced by 26 different chemical peaks. The liquid organic phase was then evaporated to remove low molecular weight liquid phase hydrocarbons, including, but not limited to, HBS, yielding a solid phase Hydrophobic Biohydrocarbon product. The resulting Hydrophobic Biohydrocarbon product transitioned to liquid phase at above 50° C. The Hydrophobic Biohydrocarbon was then cooled and remelted multiple times to confirm its unique thermoplastic and other physical properties, transitioning from liquid to solid and back again despite the absence of HBS or other solvents. In addition, the same Hydrophobic Biohydrocarbon product had a viscosity similar to water at 380° C.

Experiment 2: Production of Liquid Phase Hydrophobic Biohydrocarbon

Pinewood was processed using the same parameters as experiment 1 and separated to produce a liquid organic phase that was partially evaporated to remove HBS components with molecular weights equal to or lower than butanol, thereby allowing a portion of the HBS to remain with the Hydrophobic Biohydrocarbon at approximately 15% by weight. The resulting material was a liquid at room temperature. In a variation of this experiment, a solid phase Hydrophobic Biohydrocarbon sample was ground into a granular material and blended with butanol, resulting in partial dissolution. In another variation of this experiment, a solid phase Hydrophobic Biohydrocarbon sample was ground into a granular material and blended with an equal blend of furfural and butyl acetate, resulting in full dissolution.

Experiment 3: Characterization of Hydrophobic Biohydrocarbon

The solid Hydrophobic Biohydrocarbon sample was characterized and subjected to GC/MS, NMR, TGA, DSC and rheology testing, confirming unique composition and molecular structure in contrast to conventional lignin and other materials. 2D-NMR testing revealed the absence of lignin and the presence of several new peaks representing fatty acid esters and other extractives. Test results also demonstrated a high elemental carbon percentage of about 71%. The content of aliphatic hydroxyl groups was low, but the material had a high amount of long chain aliphatic and aliphatic ester chains. Results from GC/MS revealed that phenolic monomers and oligomers were derived from extensive lignin depolymerization, and further undergo reactions with the various other feedstock derivatives in addition to the wood extractives, resulting in Hydrophobic Biohydrocarbon products including ester and long chain aliphatic structures. DSC testing results showed a low glass transition point, and that viscosity dropped below 1,000 Pa·s at temperatures above 131° C. TGA showed high thermal stability and high fixed carbon content and C-NMR results showed high aliphatic C—C content.

Experiment 4: Liquid Organic Phase

A biobased liquid polyol was added to liquid organic phase BMM prior to evaporation in the fourth stage of the presently disclosed Hydrophobic Biohydrocarbon production process. An addition rate of 25% polyol by weight was used with a standard mixer. The liquid was then evaporated at a temperature approximately of 150° C. until the HBS was removed. The resulting homogenous solid phase Hydrophobic Biohydrocarbon exhibited unique elastomeric properties, with a consistency similar to taffy. The experiment was repeated with the addition of the same polyol and a cross linking agent, resulting in a homogenous solid phase Hydrophobic Biohydrocarbon that performed like rubber.

Experiment 5: Reactive Phase Separation

Experiment 1 was repeated with a solvent group comprised of methanol and water, yielding a Cellulosic Biopolymer and residual homogenous BMM stream with miscible methanol and water. Hexane was added to the BMM to cause a portion of the hydrophobic biohydrocarbons to separate by gravity. The solvents were removed to produce a solid phase Hydrophobic Biohydrocarbon material.

Experiment 6: Functional Additives to Hydrophobic Biohydrocarbon

The liquid organic phase from experiment 1 containing the HBS and liquid phase depolymerized biomass derivatives (Hydrophobic Biohydrocarbon precursors) was placed in a mixing vessel with carbon black at a ratio of 10% by weight. The HBS was evaporated to produce a homogenous solid phase Hydrophobic Biohydrocarbon material containing a mixture of higher molecular weight hydrocarbons resulting from polymerization of the Hydrophobic Biohydrocarbon precursors and the substantial majority of the carbon black. The resulting composition was then run through an extrusion system wherein the resulting composition was melted and extruded into a simple rod shape. The solid phase Hydrophobic Biohydrocarbon from experiment 1 without the carbon black was also processed through the melt extrusion system for comparison. The "enriched" Hydrophobic Biohydrocarbon product (with carbon black) had different rheology, increased melt strength, increased overall strength, and an increased melting point.

Experiment 7: Cellulosic Sugar and Cellulosic Ethanol

The Cellulosic Biopolymer from experiment 1 was separated into three samples that were washed to remove residual hydrophobic solvent, HBS, Hydrophobic Biohydrocarbon, or other impurities with three different methods. The first sample was washed with water. The second sample was washed with steam for 3 minutes. The third sample was washed with hot butanol and then water washed. Samples 1 and 2 pulled out residual hydrophobic solvents and other impurities, but did not have an effect on the enzymatic conversion to sugar from the Cellulosic Biopolymer. The third sample exhibited an increased hydrolysis yield of 1% to cellulosic sugar. All three samples exhibited increased hydrolysis yield as compared to the control without washing. An enzyme from Novazyme was introduced to each washed Cellulosic Biopolymer for hydrolysis at 50° C. and a pH of 5.5, resulting in sugar production at more than 80% by weight yield, thereby confirming the efficacy of "disinhibition" during the presently disclosed production process by removal of substantially hydrophobic and other impurities known to interfere with or prevent hydrolysis. The sugar was then subjected to fermentation to produce ethanol and $CO_2$ at 51% and 49% by weight yield, respectively.

Experiment 8: Polymerization and Purification

Solid phase Hydrophobic Biohydrocarbon was ground into a fine granular material using standard milling equipment and mixed with water at a ratio of 1 part Hydrophobic Biohydrocarbon powder to 10 parts water at temperatures of 25° C., 60° C. and 90° C. After mixing the Hydrophobic Biohydrocarbon material was filtered out. The third higher temperature test resulted in a "reformation" of the solid phase Hydrophobic Biohydrocarbon product with the consistency of hot taffy and a high degree of stickiness. After drying and cooling, the three solid samples were analyzed by GC/MS. The samples washed at 25° C. and 60° C. exhibited low molecular weight constituents that decreased with wash temperature. The final sample that was washed at 90° C. had negligible concentrations of low molecular weight constituents. The dried solids from both the 25° C. and 90° C. tests where then evaluated for their melting points. The 25° C. sample maintained the same melting point as the starting Hydrophobic Biohydrocarbon material of approximately 80° C., however, the 90° C. sample had a significantly higher melting point at 150° C. The same two samples were then run through a laboratory extrusion process to confirm that the melt strength of the 90° C. sample was significantly increased. The extruded samples from both the 25° C. and 90° C. tests where then subjected to tensile testing to confirm a doubling in tensile strength for the 90° C. material as compared to the 25° C. material, and a tripling in tensile strength for the 90° C. material as compared to the original solid phase Hydrophobic Biohydrocarbon sample.

Experiment 9: Purification of the Liquid Organic Phase

Another experiment was designed where the BMM produced after the second stage of the presently disclosed production process vigorously mixed with an equal volume of water. The resulting solution was subjected to gravimetric phase separation, resulting in a liquid organic phase that was then evaporated to produce Hydrophobic Biohydrocarbon. The resulting Hydrophobic Biohydrocarbon product was comprised of a mixture of higher molecular weight hydrocarbons with a higher melting point as compared to Hydrophobic Biohydrocarbon produced without the additional water mixing step.

Experiment 10: Additives

The solid phase Hydrophobic Biohydrocarbon from experiment 1 was tested to confirm 70.9% carbon, 5.4% hydrogen, and 23.7% oxygen content. The process to create the Hydrophobic Biohydrocarbon was repeated with the addition of a hydrogen donor, thereby increasing hydrogen and decreasing oxygen.

Experiment 11: Feedstock Variance

Solid phase Hydrophobic Biohydrocarbon products were produced from a softwood yellow pine biomass feedstock and a hardwood poplar biomass feedstock. Both Hydrophobic Biohydrocarbon products exhibited melt flowable thermoplastic characteristics and transition to low viscosity liquids at elevated temperatures, but had different compositions, characteristics, and melting points as itemized below:

| | |
|---|---|
| Energy | |
| Softwood Yellow Pine | 12,314-13,000 BTU/lb |
| Hardwood Poplar | 11,461-11,743 BTU/lb |
| Carbon | |
| Softwood Yellow Pine | 70.59% |
| Hardwood Poplar | 62.5% |
| Oxygen | |
| Softwood Yellow Pine | 23.7% |
| Hardwood Poplar | 30.75% |
| Hydrogen | |
| Softwood Yellow Pine | 5.37% |
| Hardwood Poplar | 5.05% |

-continued

| | |
|---|---|
| Sulfur | |
| Softwood Yellow Pine | 0.03% |
| Hardwood Poplar | 0.09% |
| Melting Point | |
| Softwood Yellow Pine | 85° C. |
| Hardwood Poplar | 90° C. |
| Glass Transition Point | |
| Softwood Yellow Pine | 65° C. |
| Hardwood Poplar | 75° C. |
| Viscosity | |
| Softwood Yellow Pine | 10 Pa · s at 160° C.-1000 Pa · s at 131° C. |
| Hardwood Poplar | 10 Pa · s at 155° C. |

Experiment 12: HBHC Analytical Test Data

The solid hydrophobic biohydrocarbon material in solid form was ground into a fine particulate using a high speed food grinding system. The material was tested at a certified laboratory for humic compound analysis. Using standard methods for the evaluation of humic compounds, the results (below) showed that the hydrophobic biohydrocarbon material comprises humic acid and fulvic acid that are both classified as "humic compounds."

| | | |
|---|---|---|
| Humic Acid method | 61.91% | J. M. Verploegh and L. A. Brandvold |
| Fulvic Acid method | 13.81% | CDFA HA4/JC |
| Moisture Content | 1.7% | AOAC 937.03 |

The unique properties of humic compounds are mainly due to the presence of different types of organic functional groups, from polar (carboxyl, hydroxyl, amino, methoxy and phenolic) to nonpolar (aliphatic and aromatic), which are responsible for the occurrence of hydrophilic and/or hydrophobic domains in the humic structures. It is known that carboxyl groups (in neutral or anionic form) belong to the most abundant and active functionalities of humic compounds, and are accountable, for example, for ion exchange properties of humic compounds in relation to metal ions.

Experiment 13: Ratio of Ethanol Addition

The solid hydrophobic biohydrocarbon material in solid form was ground into fine particulate using a high-speed food grinding system. The material was then blended with various percentages of ethanol and mixed on a magnetic stirring device at a temperature of 40° C. Additions of the HBHC in ethanol were 10, 20, 30, 40, 50 and 60% addition by weight.

At 10, 20 and 30% HBHC blended in ethanol, a "taffy" like, soft elastomeric material formed from a portion of the HBHC. After filtering out this elastic solid, the soft elastomeric material represented about 29% of the total admixture of a 30% HBHC to 70% ethanol. A portion of the ethanol was believed to be converted into higher molecular weight hydrocarbons upon mixing, reaction, or other combination with the HBHC powder, and a portion of the solid phase HBHC was believed to be depolymerized to liquid phase HBHC with lower molecular weight hydrocarbons. The remaining soft elastomer solid phase HBHC derivative was not believed to convert to liquid phase HBHC under the stated conditions, despite the presence of excess ethanol.

The HBHC reactivity with ethanol is believed to be concentration dependent under the stated conditions, such that the soft elastomer solid phase HBHC derivative present at the 10, 20, and 30% HBHC concentrations was unexpectedly not present at 50 or 60%. The 50 and 60% HBHC blends were homogenous with a viscosity and appearance that was similar to motor oil.

Importantly, the 60% HBHC blend approximates the natural output of the inventive process, in which, in applicable embodiments, about 24 to 25% of the lignocellulosic feedstock mass is converted to ethanol and about 38 to 40% of the lignocellulosic feedstock mass is converted into HBHC. Advantageously, whereas the HBHC is solid phase at room temperature upon removal of the low molecular weight hydrophobic portion, the 60% HBHC ethanol blend is a homogenous liquid phase product that can be refined into renewable fuel at reduced cost.

Experiment 14: Hydrogen Donor Ratios

The "taffy" like soft elastomer solid phase HBHC derivative present in the 30% HBHC to 70% ethanol mixture in the foregoing example was believed to be decomposed or otherwise modified into liquid phase hydrocarbons upon introduction of hydrogen donors, such as citric acid or oxalic acid. A small percentage of very fine HBHC particles remained upon addition of citric or oxalic acid at 13% concentration, however, no solid phase HBHC derivatives were present in the 30% solution upon addition of citric or oxalic acid at 23% concentration.

It will be understood that certain features and sub combinations are of utility and may be employed without reference to other features and sub combinations. This is contemplated by and is within the scope of the claims.

As many possible embodiments may be made of the disclosure without departing from the scope thereof, and it is to be understood that all matter herein set forth or shown in the accompanying drawings is to be interpreted as illustrative and not in a limiting sense.

Although the presently disclosed methods have been described in conjunction with the specific language set forth herein above, it is evident that many alternatives, modifications, and variations will be apparent to those skilled in the art. Accordingly, it is intended to embrace all such alternatives, modifications, and variations that fall within the spirit and broad scope of the present disclosure. Changes may be made in the construction and the operation of the various components, elements, and assemblies described herein, as well as in the steps or the sequence of steps of the methods described herein, without departing from the spirit and scope of the present disclosure.

What is claimed is:

1. A hydrophobic biohydrocarbon comprising a mixture of substantially hydrophobic hydrocarbons derived from lignocellulosic biomass and further comprising hydrophobic phenols, hydrophobic organic furans, hydrophobic oleoresins, and hydrophobic esters.

2. The hydrophobic biohydrocarbon of claim 1 wherein hydrophobic esters comprise oleoresins.

3. The hydrophobic biohydrocarbon of claim 1 wherein hydrophobic esters comprise butyl ester.

4. The hydrophobic biohydrocarbon of claim 1 wherein hydrophobic furans comprise furfural derived from hemicellulose further deriving from the lignocellulosic biomass.

5. The hydrophobic biohydrocarbon of claim 1 wherein hydrophobic phenols comprise depolymerized lignin deriving from the lignocellulosic biomass.

6. The hydrophobic biohydrocarbon of claim 1 with a water content of less than 10% by weight.

7. The hydrophobic biohydrocarbon of claim 1 with a carbon content in a range of about 50% to about 90% by weight.

8. The hydrophobic biohydrocarbon of claim 1 with a renewable carbon content in a range of about 30% to about 80% by weight.

9. The hydrophobic biohydrocarbon of claim 1 with a hydrogen content in a range of about 4% to about 15% by weight.

10. The hydrophobic biohydrocarbon of claim 1 with an oxygen content of less than 40% by weight.

11. The hydrophobic biohydrocarbon of claim 1 with a sulfur content of less than 4% by weight.

12. The hydrophobic biohydrocarbon of claim 1 wherein water-soluble and hydrophilic compounds are less than 10% by weight.

13. The hydrophobic biohydrocarbon of claim 1 with an energy content in a range of about 11,000 to about 25,000 btu per pound.

14. The hydrophobic biohydrocarbon of claim 1 with thermoplastic characteristics.

15. A hydrophobic biohydrocarbon derived from lignocellulosic biomass comprising a mixture of substantially hydrophobic hydrocarbons further comprising hydrophobic phenols, hydrophobic organic furans, hydrophobic oleoresins, and hydrophobic esters, wherein the hydrophobic biohydrocarbon has a carbon content in a range of about 50% to about 90% by weight, an oxygen content of less than 40% by weight, a hydrogen content in a range of about 4% to about 14% by weight, an energy content of more than 11,000 btu per pound and less than 25,000 btu per pound, a water content less than 10%, and a water-soluble and hydrophilic compound content less than 10% by weight.

16. A hydrophobic biohydrocarbon comprising a mixture of substantially hydrophobic hydrocarbons derived from lignocellulosic biomass further comprising hydrophobic phenols, hydrophobic organic furans, hydrophobic oleoresins, and hydrophobic esters, wherein the hydrophobic biohydrocarbon has a carbon content of 50% by weight, an oxygen content of 30% by weight, a hydrogen content of 4%, an energy content of 11,000 btu per pound, a water content of 6%, and a water-soluble and hydrophilic compound content of 10% by weight.

17. The hydrophobic biohydrocarbon of claim 1, further comprising humic compounds such as humic acid and fulvic acid.

18. The hydrophobic biohydrocarbon of claim 17, wherein the humic compound content is greater than 40%.

19. The hydrophobic biohydrocarbon of claim 1, further comprising ethanol to create a liquid HBHC.

20. The hydrophobic biohydrocarbon of claim 17, wherein the ethanol addition is in a range from 35% to 90%.

21. The hydrophobic biohydrocarbon of claim 17, further comprising the addition of a hydrogen donor selected from the group consisting of citric acid, oxalic acid, and combinations thereof.

* * * * *